United States Patent [19]

Nagahashi et al.

[11] Patent Number: 4,983,154

[45] Date of Patent: Jan. 8, 1991

[54] CARTON ASSEMBLING METHOD AND EQUIPMENT

[75] Inventors: Toshio Nagahashi, Chiba; Kiyoshi Yamashita, Ibaraki; Minoru Sato, Chiba, all of Japan

[73] Assignee: Tokyo Automatic Machinery Works, Ltd., Tokyo, Japan

[21] Appl. No.: 186,583

[22] Filed: Apr. 27, 1988

[51] Int. Cl.[5] ..... B31B 1/80

[52] U.S. Cl. ..... 493/315; 493/311; 493/310; 493/318; 493/319; 493/408

[58] Field of Search ..... 493/311, 313, 315, 316, 493/318, 408, 309, 310, 319, 430, 446, 447, 456

[56] References Cited

U.S. PATENT DOCUMENTS

| | | | |
|---|---|---|---|
| 2,699,712 | 6/1955 | Meyer-Jagenberg | 493/310 |
| 2,726,584 | 12/1955 | Griswold | 493/310 |
| 2,915,308 | 12/1959 | Matzen . | |
| 3,534,667 | 10/1970 | Krause | 493/310 |
| 4,057,008 | 11/1977 | Hughes | 493/313 |
| 4,518,301 | 5/1985 | Greenwell . | |
| 4,578,054 | 3/1986 | Herrin | 493/309 |

FOREIGN PATENT DOCUMENTS

| | | |
|---|---|---|
| 59-26833 | 2/1984 | Japan . |
| 61-60420 | 3/1986 | Japan . |

*Primary Examiner*—Frederick R. Schmidt
*Assistant Examiner*—Jack Lavinder
*Attorney, Agent, or Firm*—Sandler, Greenblum & Bernstein

[57] ABSTRACT

Disclosed are carton assembling method and equipment for sucking and taking out flatwise folded cartons one by one from a magazine by means of suction cups, unfolding each carton squarely on a conveyance path while transferring it downward along a rotative path, and supplying the thus-unfolded cartons to an encasing machine by means of a conveyance mechanism. Each carton is held squarely by a pair of stoppers, utilizing its reaction force acting in the returning direction. Thereafter, the carton is reverse-folded against such reaction force and then unfolded again to remove the folding tendency of the carton acting in the folded direction, thereby permitting the carton to hold itself in a square shape. And at the time of reverse folding, the flaps of each carton are expanded so that a contents charging conveyor can be disposed in close proximity to the cartons.

14 Claims, 23 Drawing Sheets

CARTON ASSEMBLING METHOD AND EQUIPMENT

BACKGROUND OF THE INVENTION

1. Field of the Invention

The present invention relates to carton assembling method and equipment for sucking and thereby taking out flatwise-folded cartons one by one from a magazine by means of suction cups of a rotative transfer mechanism, then unfolding each carton in a square shape while transferring it downward along a rotative path, and supplying the thus-unfolded carton to an encasing machine by means of a conveyance mechanism.

2. Description of the Prior Art

According to conventional carton assembling method and equipment of this type, for example as disclosed in Japanese Patent Laid Open No. 60420/86, there is provided a rotative transfer mechanism of a construction wherein three planetary gear trains are engaged with a fixed gear communicating with a drive source and a suction cup is attached to an outer-end gear of each such planetary gear train, and also provided is a conveyance mechanism of a construction wherein a large number of partition plates are erected on a belt conveyor at equal intervals each corresponding to the width of each carton which belt conveyor is driven in synchronism with the above rotative transfer mechanism. Each planetary gear train rotates along the outer periphery of the fixed gear, causing each suction cup to move rotatively downward along a hypotrochoid path, whereby cartons are sucked and taken out successively from the magazine. Folded edges of each carton are brought into sliding pressure contact with the partition plates which are moving horizontally at constant speed, thereby unfolding the carton gradually, then the suction is released and the front and rear faces of the carton are held between adjacent partition plates. In this state the carton is transferred to an encasing machine while being kept upright.

However, in such conventional carton assembling method and equipment, each carton unfolded on the conveyance path and held squarely by the partition plates cannot be unfolded exactly in a square shape because the carton is under the action of a continuous folding tendency which tries to return to the folded direction. So in the event of even a slight dimensional error between the width of the carton and the spacing of adjacent partition plates for conveyance to the encasing machine, the carton will be deformed into parallelogram due to the above-mentioned action, thus causing the problem that a squarely unfolded carton is not always obtainable as a product.

In the above conventional method and equipment, moreover, not only it is difficult to adjust the timing between the moving path of folded edges of each carton and the horizontal movement of partition plates, but also since the carton is introduced into the space between partition plates at a vertex part of a generally triangular hypotrochoid path, it is impossible to obtain a sufficient time to unfold the carton completely squarely and so the best unfolding condition cannot be expected. This is apparent from the disclosure of Japanese Patent Laid Open No. 26833/84 wherein the carton introducing vertex part of the hypotrochoid path is changed into a generally U shape by means of a cam mechanism to approximately double the carton introducing time and there is made a high speed operation.

But the equipment disclosed therein involves the problem that the internal structure of a rotative transfer mechanism is very complicated.

The construction disclosed in the foregoing Japanese Patent Laid Open No. 60420/86 also involves problems. More particularly, since each carton is conveyed to the encasing machine by means of the belt conveyor while its flaps are projected in directions perpendicular to the conveyance direction, not only it is impossible to reduce the width of the belt conveyor but also a contents charging conveyor of the encasing machine cannot be disposed in close proximity to the cylindrical portions of the cartons on the conveyor, resulting in increased size of the entire equipment. Besides, a contents charging pusher disposed so that it can protrude and retract with respect to the cylindrical portion of each carton, is required to be longer in stroke by the length corresponding to the projecting length of the flaps, thus resulting in increased time required for the charging of contents.

In the above prior art, moreover, since contents are charged into each carton while the flaps are kept projected in directions perpendicular to the conveyance direction, if the flaps are inclined inwards even slightly, they will be rolled inside in charging the contents, resulting in that the contents are not exactly charged into the carton.

SUMMARY OF THE INVENTION

It is an object of the present invention to unfold a carton squarely in a reverse-foldable manner and remove its folding tendency by a simple structure in order to eliminate the aforementioned inconveniences of the conventional carton assembling method and equipment.

It is another object of the present invention to effect both removal of the folding tendency and enfolding of flaps by reverse-folding a carton at an angle of 180° in order to eliminate the aforementioned inconveniences of the conventional carton assembling method and equipment.

It is a further object of the present invention to provide a carton assembling equipment capable of easily coping with changes in size of carton.

Such method of the first invention in the present case is characterized in that a folded edge of a carton being transferred downward along a rotative path is brought into sliding pressure contact with fixed, inclined guides which gradually approach the path of movement of the folded edge, thereby unfolding the carton gradually; a pair of opposed, folding-side corner portions on each opening side of the thus-unfolded carton are held squarely between a pair of stoppers; thereafter the carton is moved in a direction in which both such folding-side corner portions approach each other, thereby reverse-folded, and then unfolded squarely again. The equipment of the first invention in the present case is characterized in that fixed, inclined guides are each erected on a conveyance path so as to gradually approach the path of movement of a folded edge of a carton; lower stoppers are disposed below and contiguously to the fixed, inclined guides; upper stoppers adapted to engage folding-side corner portions of the upper surface of the carton are each disposed in the space above the conveyance path; and in front of the upper stoppers in the conveyance direction there are disposed reverse-folding means which is lower in the forward direction as well as reunfolding means for compressing a reverse-folded carton in the front and rear direction.

The method of the second invention in the present case is characterized in that a folded edge of a carton being transferred downward along a rotative path is brought into sliding pressure contact with fixed, inclined guides which gradually approach the moving path of the folded edge, to unfold the carton gradually; a pair of opposed, folding-side corner portions on each opening side of the thus-unfolded carton are held squarely between a pair of stoppers; thereafter the carton is moved in a direction in which both such corner portions approach each other, thereby reverse-folded at an angle 180°; then the flaps of the reverse-folded carton are expanded and enfolded approximately orthogonally; and thereafter the carton is unfolded squarely again. The equipment of the second invention in the present case is characterized in that fixed, inclined guides are each erected on a conveyance path so as to gradually approach the moving path of a folded edge of a carton; lower stoppers are disposed below and contiguously to the fixed, inclined guides; upper stoppers adapted to engage folding-side corner portions of the upper surface of the carton are disposed in the space above the conveyance path; and in front of the upper stoppers in the conveyance direction there are successively disposed reverse-folding means which is lower in the forward direction, flap folding means adapted to come into abutment with the flaps of the carton to expand them approximately orthogonally, and reunfolding means for compressing the reverse-folded carton in the front and rear direction.

According to the above carton assembling method and equipment of the first invention in the present case, a folded edge of a carton is brought into sliding pressure contact with the fixed, inclined guides and pushed inwards of the carton to thereby unfold the carton gradually; a pair of opposed, folding-side corner portions on each opening side of the carton thus unfolded are held between a pair of stoppers to hold the carton in a square shape by utilizing its reaction force acting in the returning direction; further, the lower surface of the carton is conveyed toward the reverse-folding means against the said reaction force to lower the height of the carton gradually, thereby allowing both the above folding-side corner portions to approach each other to reverse-fold the carton, which is then unfolded squarely again. By such a simple structure the carton is squarely unfolded in a reverse-foldable manner and the folding tendency thereof can be removed.

Consequently, the square opening of the carton can be retained by itself independently of suction and partition plates. Even in the event of a slight dimensional error between the partition plate spacing and the width of the carton, there can be obtained a squarely unfolded carton as a product without deformation thereof.

Further, unlike the conventional equipment, laterally moving partition plates are not used, but fixed, inclined guides are used to unfold each carton squarely, so not only it is no longer necessary to make a timing adjustment between the moving path of each carton and the horizontal movement of partition plates, but also the carton can be fully unfolded squarely even when it is introduced along a hypotrochoid path. Besides, the portions to be squarely opened of the carton can each be so opened by a single fixed, inclined guide independently of dimensional changes of the carton.

According to the above carton assembling method and equipment of the second invention in the present case, each carton is reverse-folded at an angle of 180° and its flaps are expanded approximately orthogonally, thereafter the carton is compressed in the front and rear direction and again unfolded squarely, so that the removal of the folding tendency and enfolding of the flaps can be done simultaneously by reverse folding of the carton.

Consequently, a contents charging conveyor of the encasing machine can be disposed in proximity to the cylindrical portion of the unfolded carton, so that not only it is possible to reduce the size of the entire equipment but also the contents charging time can be shortened because of a shorter stroke of a contents charging pusher. Besides, the charging of contents can be done in a satisfactory manner without rolling inside of the flaps.

DETAILED DESCRIPTION OF THE PREFERRED EMBODIMENTS

Figure 1:
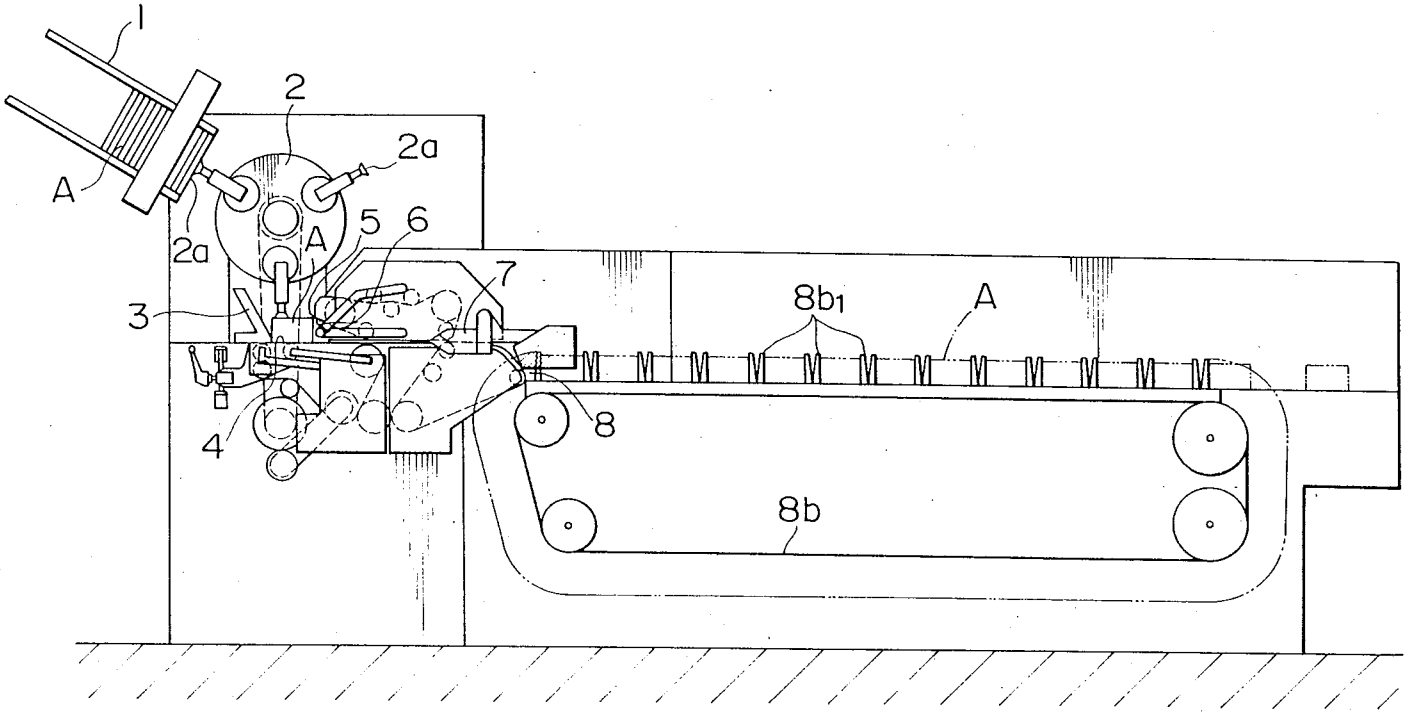
FIG. 1 is a side view of a carton assembling equipment according to an embodiment of the present invention.
Figure 2:
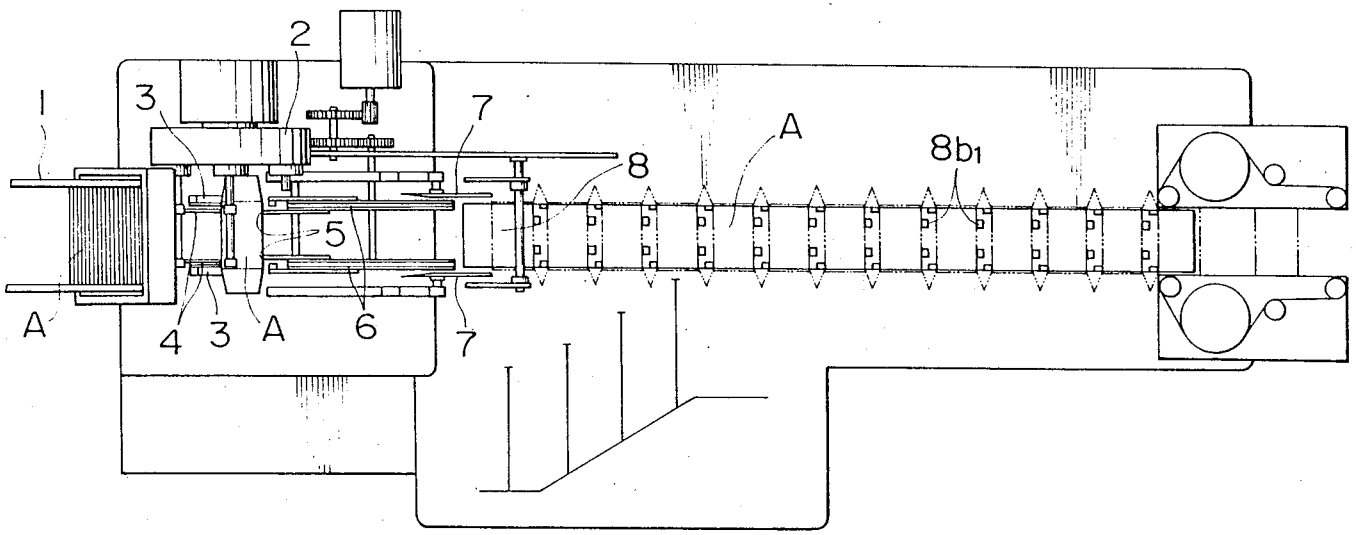
FIG. 2 is a plan view thereof.
Figure 3:
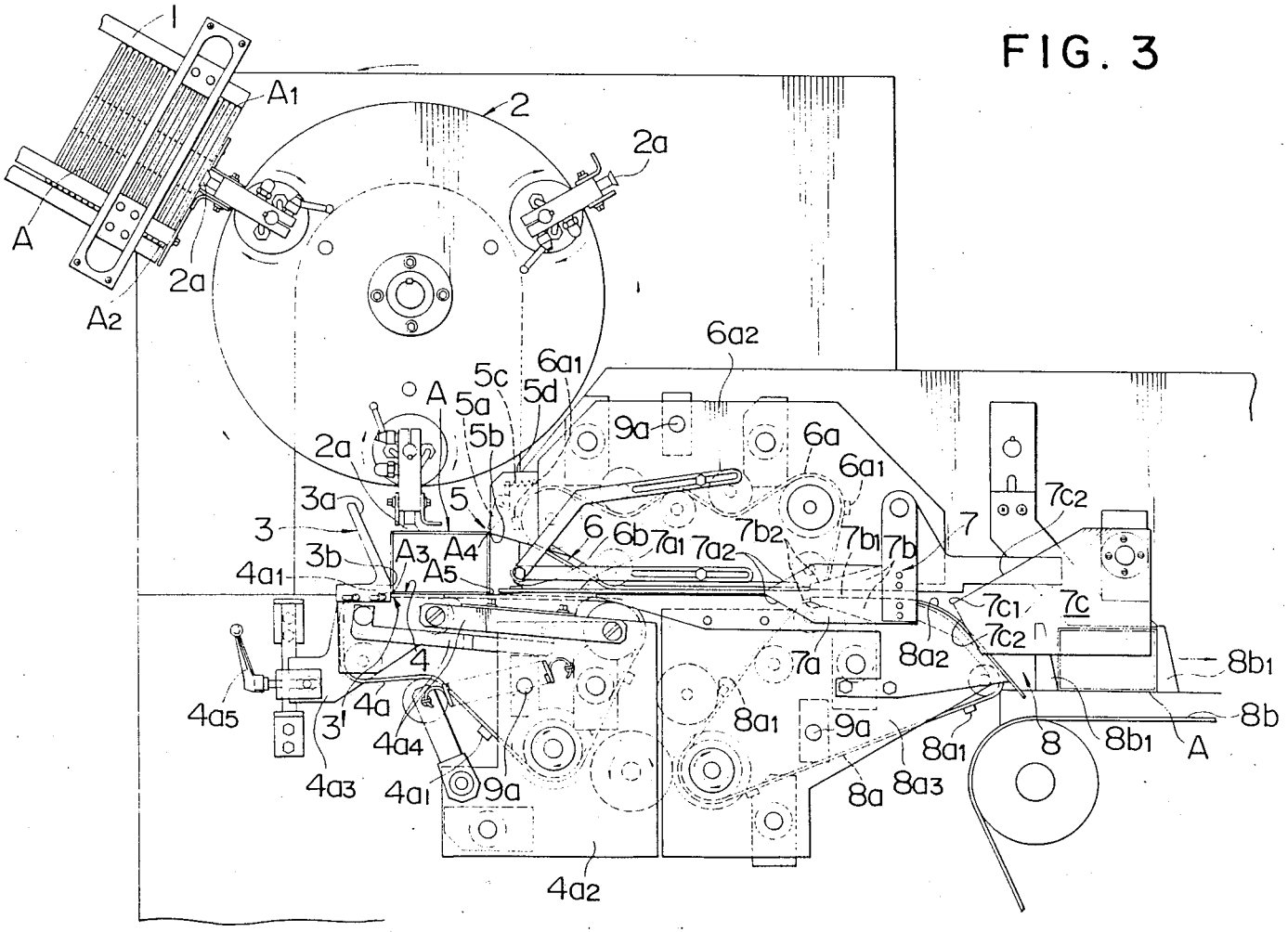
FIG. 3 is a side view showing a principal portion on a large scale.
Figure 4:
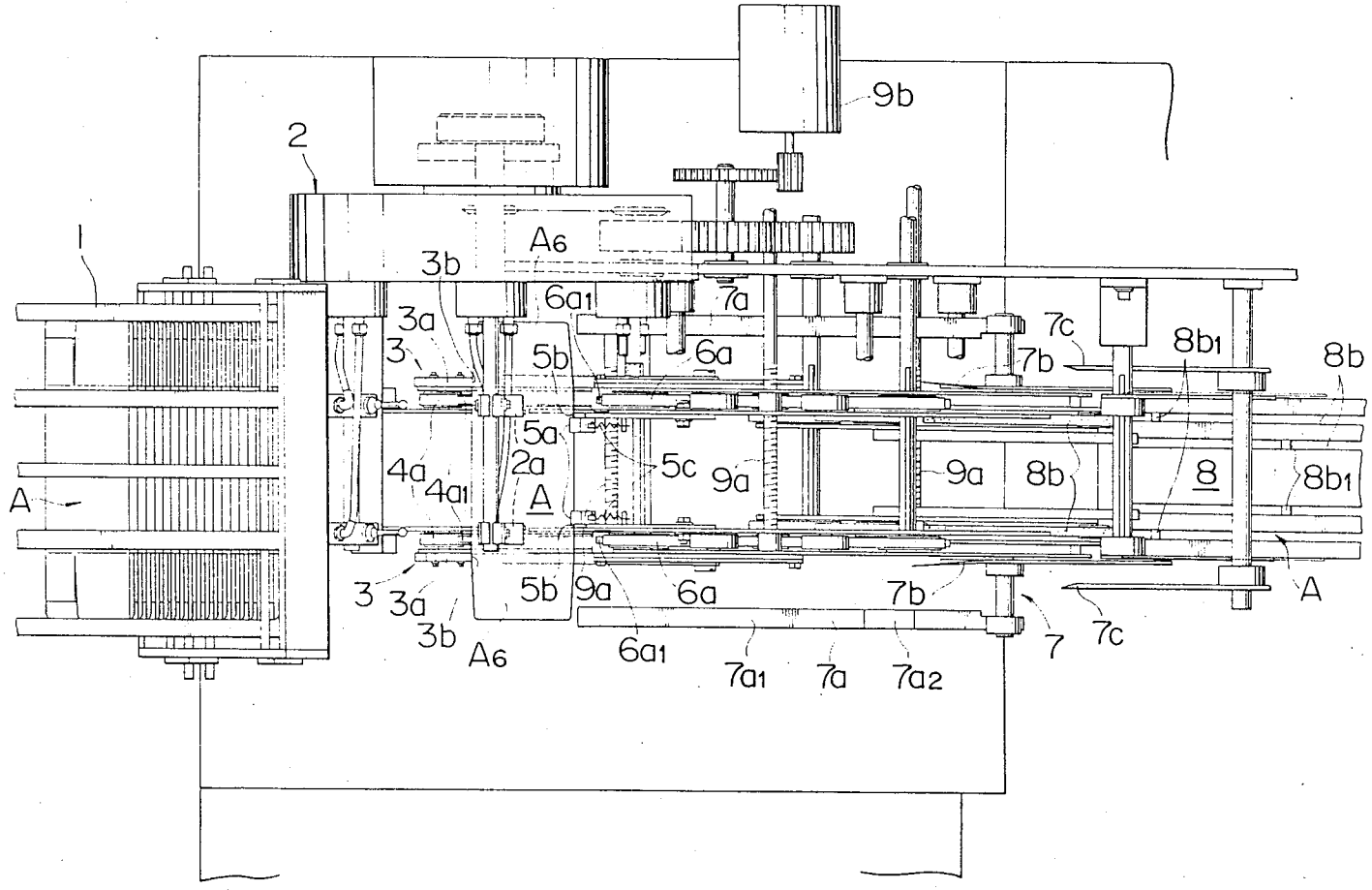
FIG. 4 is a plan view thereof.
Figure 5:
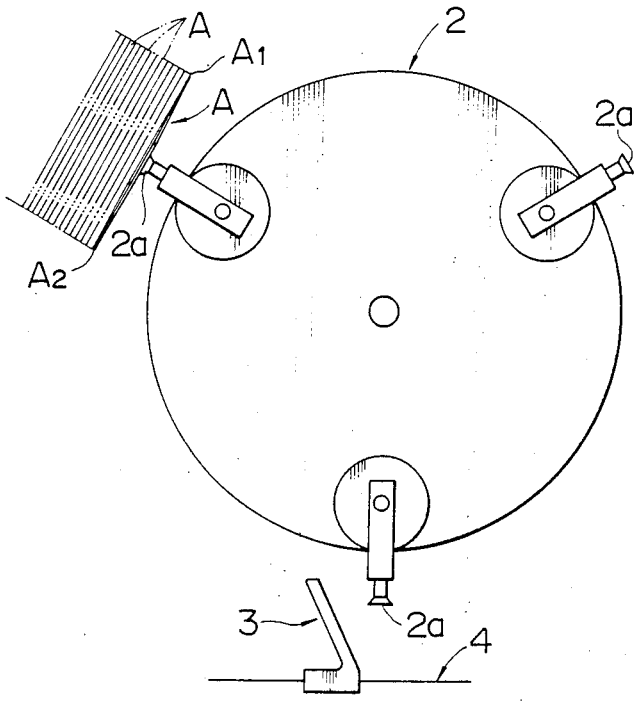
FIGS. 5 to 8 are enlarged side views of a principal portion, stepwise showing operating conditions of a rotative transfer mechanism.
Figure 6:
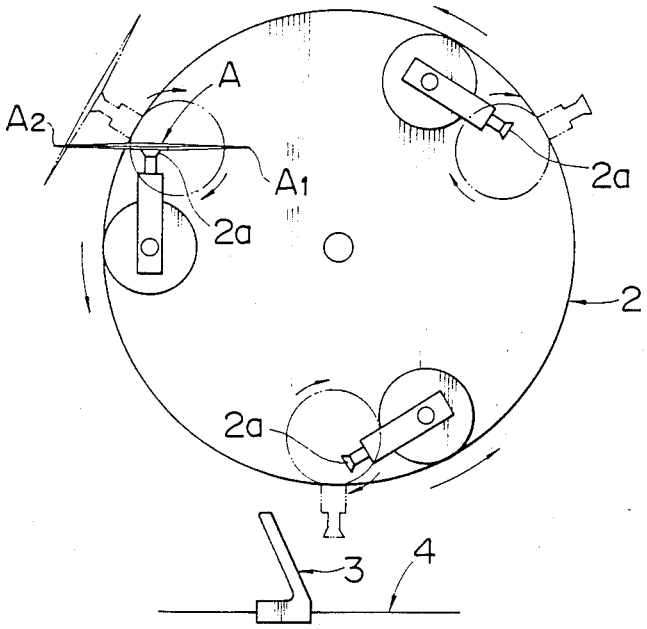
Figure 7:
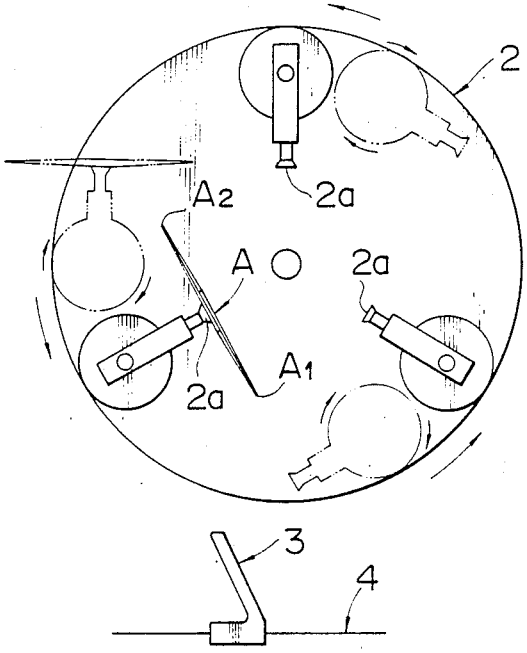
Figure 8:
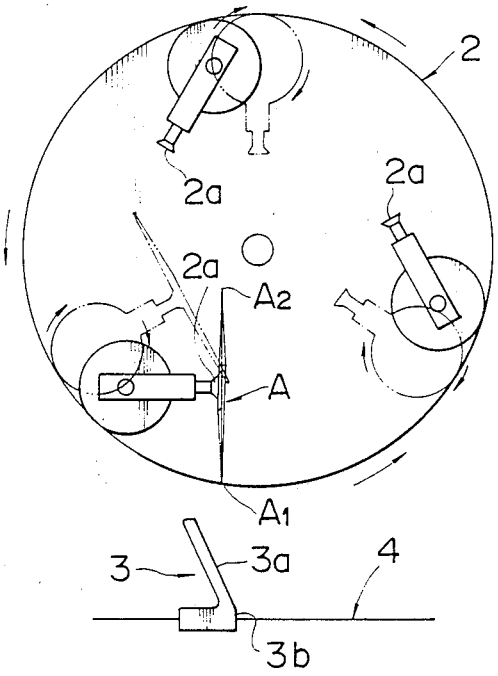

According to an embodiment of the present invention, as shown in FIG. 1, flatwise folded cartons A are taken out by suction one by one from a slantwise disposed magazine 1 by means of a rotative transfer mechanism 2 comprising plural, say three, planetary gear trains engaged with a fixed gear and three suction cups 2*a* attached to outer-end gears of those planetary gear trains. The carton A thus taken out is rotatively transferred along a hypotrochoid path to right and left, fixed, inclined guides 3 disposed below the rotative transfer mechanism 2, and the suction of the corresponding suction cup 2*a* is released at an appropriate timing.

Each fixed, inclined guide 3 is erected at the rear end with respect to a conveyance direction of a conveyance path 4 along a lower vertex part of a moving path of the suction cup 2*a*, i.e., a hypotrochoid path. On the front side thereof is formed an inclined surface 3*a* so as to approach the moving path of one folded edge A: of the carton A in a folded state gradually in a downward direction. With downward movement of the suction cup 2*a*, the one folded edge A: is brought into sliding pressure contact with the inclined surface 3*a* of each inclined guide 3 to push the carton A inwards gradually.

A vertical surface 3*b* is formed below and contiguously to the inclined surface 3*a*. The vertical surface 3*b* and the upper surface of the horizontal conveyance path 4 constitute a lower stopper 3' for retaining one folding-side corner portion $A_3$ of the carton A which is in an unfolded state to prevent it from moving backward and downward with respect to the conveyance direction.

In this embodiment, the fixed, inclined guides 3 are erected on a pair of later-described right and left rear support portions $4a_3$ movably in the conveyance direction. Their inclined surfaces 3*a* are at an angle of approximately 25 degrees.

The conveyance path 4 is a horizontal path extending from each fixed inclined guide 3 to an encasing machine (not shown). The lower surface of the carton A in an unfolded state is positioned along the upper surface of the path 4. The conveyance path 4 has a conveyance mechanism 4*a* for conveying only the lower surface side of the carton A forwardly in the conveyance direction.

The conveyance mechanism 4*a* is constituted by a belt conveyor having projections $4a_1$ formed outwards at equal intervals. A pair of such conveyance mechanisms 4*a* are disposed inside the right and left, fixed, inclined guides 3. In each conveyor 4*a*, a support portion which journals driving and driven pulleys is divided into two portions in front and in the rear with respect to the conveyance direction. These front and rear support portions, indicated at $4a_2$ and $4a_3$, are interconnected through parallel moving members $4a_4$, e.g. parallel links, extending in the conveyance direction, whereby the rear support portion $4a_3$ is supported vertically movably in a horizontal state together with the fixed, inclined guide 3 with respect to the front support portion $4a_2$, and its positioning is effected using a fixing handle $4a_5$.

Above the conveyance path 4 are disposed upper stoppers 5 at a height corresponding to the vertical height of the carton A in an unfolded state and in a front position in the width of the carton A with respect to the vertical surface 36.

The upper stoppers 5 are each composed of a holding pawl 5*a* disposed so that it can pop in and out of the moving path of the other folded edge $A_2$ of the carton A in a folded state, and a vertical surface 56 opposed to the front upper end of the carton A in an unfolded state. The holding pawl 5*a* is normally projected above the said moving path by means of a resilient member such as a spring 5c. But when the holding pawl 5*a* comes into contact with the other folded edge Az with downward movement of the suction cup 2*a*, it swings to let the folded edge pass downward and thereafter projects again to prevent an upward movement of the other folded edge $A_2$.

The upper and lower stoppers 5 and 3' constitute holding means for holding the folding-side corner portions $A_3$ and $A_4$ of the carton A on a diagonal line therebetween. By the holding means the carton A is held in a square shape, utilizing its reaction force acting in the returning direction, i.e., the folding direction.

Although in this embodiment the holding pawl 5*a* for preventing an upward movement of the other folded edge $A_2$ of the carton A in an unfolded state is disposed so that it can pop in and out of the moving path of the other folded edge $A_2$, this arrangement does not constitute any limitation. By utilizing elastic deformations of the carton A, the other folded edge $A_2$ can be held in a fixed state of the holding pawl 5*a* even without swing motion of the pawl. Further, where the holding pawl 5*a* is fixed, it can be made contiguous to the vertical surface 5*b* integrally.

In this embodiment the vertical surfaces 5*b* of the upper stoppers are formed at the rear end faces of parallel mounting plates 5*d* extending in the conveyance direction, and the holding pawls 5*a* are supported by the mounting plates 5*d* through shafts and thus disposed right and left in a pair. Further, the mounting plates 5*d* are each provided with elongated apertures 5*d* extending in the conveyance direction through the wall thereof. Each mounting plate 5*d* is attached to and supported by a support portion $6a_2$ of a later-described reverse-folding conveyor 6*i* a through the elongated apertures 5*d* so as to be movable forward and backward with respect to the conveyance direction.

Further, in the lower end position of each upper stopper 5 is disposed a reverse-folding means 6 extending forward in the conveyance direction from that position along the conveyance path 4, in an inclined manner so that its height from the upper surface of the conveyance path 4 is lower toward the front. Consequently, the carton A in an unfolded state is inclined by the reverse-folding means 6 so that its opposed, folding-side corner portions $A_3$ and $A_4$ approach each other whereby the carton is folded in a direction reverse to the pre-folded direction in the magazine 1.

The reverse-folding means 6, which are disposed in a pair outside the right and left upper stoppers 5, are each constituted by a belt conveyor 6*a* with a projection $6a_1$ inclined downward toward the front in the conveyance direction. The spacing between the lower end faces of the right and left, reverse-folding conveyors 6*a* and the upper surfaces of the right and left transfer conveyors 4a is set at approximately the same as the thickness of the carton A in a folded state, whereby a reverse folding of 180 degrees is effected.

In this embodiment, moreover, in addition to the reverse-folding conveyors 6a,6a, squeezing rollers 6b are connected to the support portions $6a_2$ which journal driving and driven pulleys of the reversefolding conveyors 6a, so as to be movable vertically as well as forward and backward with respect to the conveyance direction. Lower corner portions $A_5$ on the front side of the carton A in an unfolded state are pressed flatwise by the right and left squeezing rollers 6b, and thereafter the carton is conveyed by the right and left reverse-folding conveyors 6a, whereby it is intended to effect reverse folding smoothly. But, if reverse folding can be done with the reverse-folding conveyors 6a,6a alone, it is not necessary to provide the squeezing rollers 6b.

In front of the reverse-folding means 6 in the conveyance direction are disposed flap folding means 7 for expanding upper flaps $A_6$, lower flaps $A_7$, front flaps $A_8$ and rear flaps $A_9$ of the carton A in a reverse-folded state along the right and left side edges of the conveyance path 4.

The flap folding means 7 are composed of a pair of right and left guide members 7a adapted to be inserted between the upper and lower flaps $A_6$ and $A_7$, respectively, to expand those flaps in the vertical direction, a pair of right and left, upper and lower flap enfolding plates 7b for enfolding at an expanded angle of 90° the upper and lower flaps As and A, which have been expanded by the guide members 7a,7a and a pair of right and left, front and rear flap enfolding plates 7c for enfolding the front and rear flaps $A_8$ and $A_9$ at an expanded angle of 90°, the guide members 7a and the flap enfolding plates 7b and 7c being successively disposed forward in the conveyance direction and each supported movably in the transverse direction.

Each guide member 7a is formed in the shape of a horizontal batten whose rear half portion extends up to the rear end position of the reverse-folding means 6 in parallel with the right and left side edges of the conveyance path 4, and the said horizontal batten portion, indicated at $7a_1$, is inserted between the upper and lower flaps $A_6$ and $A_7$ by utilizing a front-rear dislocation of those flaps occurring when the carton A is reverse-folded. Further, there are formed upper and lower inclined surfaces 7ahd 2 which are inclined at an angle of about 30° gradually upward and downward, respectively, from a position intermediate between the front and the rear toward the front. The upper and lower flaps $A_6$ and $A_7$ are moved forward along the inclined surfaces $7a_2$, whereby they are gradually expanded in the vertical direction.

The upper and lower flap enfolding plates 7b are each provided in a pair of upper and lower plates through a gap $7b_1$ which is for the insertion of the front and rear flaps $A_8$ and $A_9$; they are disposed inside the upper and lower inclined surfaces $7a_2$, namely in the positions corresponding to the base ends of the upper and lower flaps $A_6$ and $A_7$. On the respective rear face sides are formed inclined surfaces $7b_2$,$7b_2$ which are inclined gradually upward and downward toward the front and inclined toward the inside of the conveyance path 4. The upper and lower flaps $A_6$ and $A_7$ are advanced along the upper and lower inclined surfaces 7b whereby they are enfolded at an angle of 90° while being further expanded in the vertical direction.

The front and rear flap enfolding plates 7c are each disposed inside the guide member 7a like the upper and lower flap enfolding plates 7b. On the rear face side thereof is provided a vertex $7c_1$ in a vertically intermediate position so as to be located between the front and rear flaps $A_8$ and $A_9$, and there are formed upper and lower inclined surfaces $7c_2$ inclined gradually upward and downward respectively from the vertex $7c_1$ toward the front. The front and rear flaps $A_8$ and $A_9$ are advanced along the upper and lower inclined surfaces $7c_2$, whereby they are enfolded at an angle of 90° while being expanded in the vertical direction.

Further, in front of the flap folding means 7 in the conveyance direction there is disposed a reunfolding means 8 for compressing the carton A which is in a reverse-folded state, in the conveyance direction and again unfolding it squarely.

The reunfolding means 8 comprises belt conveyors 8a disposed in front of the transfer conveyors 4a and interlocked therewith in synchronism, the belt conveyors 8a having a pair of right and left projections $8a_1$, discharge conveyors 8b disposed at a falling distance from downwardly curved surfaces $8a_2$ at the front ends of the right and left reunfolding conveyors 8a, the discharge conveyors 8b having a large number of conveyance pawls $8b_1$ erected thereon at equal intervals each corresponding to the width of the carton A, the conveyance pawls $8b_1$ being movable forward and backward with respect to the conveyance direction, and inclined plates 8c for guiding a front edge $A_{11}$ of the carton A, the inclined plates 8c being disposed in a downwardly inclined state opposed to the downwardly curved surfaces $8a_2$. A rear edge $A_{10}$ of the carton in a reverse-folded state is pushed forward by the projections 8a and the front edge $A_{11}$ thereof is moved along the inclined plates 8c and is brought into abutment with conveyance pawls $8b_1$ moving horizontally to compress the carton in the front and rear direction while the carton is allowed to fall along the downwardly curved surfaces $8a_2$, whereby the carton is unfolded squarely. At the same time, the front and rear faces of the carton A are held between the said conveyance pawls $8b_1$ and other conveyance pawls $8b_1$ which rise gradually from behind the reunfolded carton A with advance of the former conveyance pawls $8b_1$, and in this state the carton A is conveyed to an encasing machine (not shown). Further, horizontal surfaces $8c_1$ for preventing the floating of the carton A are contiguous to the lower ends of the inclined plates 8c with a spacing a little longer than the vertical height of the carton A with respect to the upper surfaces of the discharge conveyors 8b.

The right and left transfer conveyors 4a,4a , reverse-folding conveyors 6a,6a and reopening conveyors 8a,8a are threadedly engaged with either the right or the left of right and left support portions $4a_2$,$4a_2$; $6a_2$,$6a_2$; and $8a_3$,$8a_3$. which journal driving and driven pulleys, through three screw shafts 9a extending between those support portions in the direction perpendicular to the conveyance direction. The screw shafts 9a are connected to an adjusting motor 9b so that the spacings of the right and left support portions 4a,$4a_2$; $6a_2$,$6a_2$; and $8a_3$,$8a_3$ are adjusted simultaneously in the transverse or the right and left direction by forward and reverse rotations of the motor 9b. Further, to the moving-side support portions $4a_2$, $6a_2$ and $8a_3$ are connected either in each set of the right and left guide members 7a,7a of the flap folding means, the upper and lower flap enfolding plates 7b,7c and the front and rear flap enfolding plates 7c,7c through connecting members (not shown) so that the right and left guide members 7a, the upper and lower flap enfolding plates 7b and the front and rear flap enfolding plates 7c are adjusted interlockedly with adjustment in spacing of the right and left support portions $4a_2$,$4a_2$; $6a_2$, $6a_2$; $8a_3$,$8a_3$.

The operation of such carton assembling equipment will be described below.

First, the rotative transfer mechanism 2 is driven to take out by suction the flatwise folded cartons A one by one from the magazine 1. Each carton A thus taken out is rotatively transferred downward along such a hypotrochoid path as shown in FIGS. 5 to 8.

Figure 9:
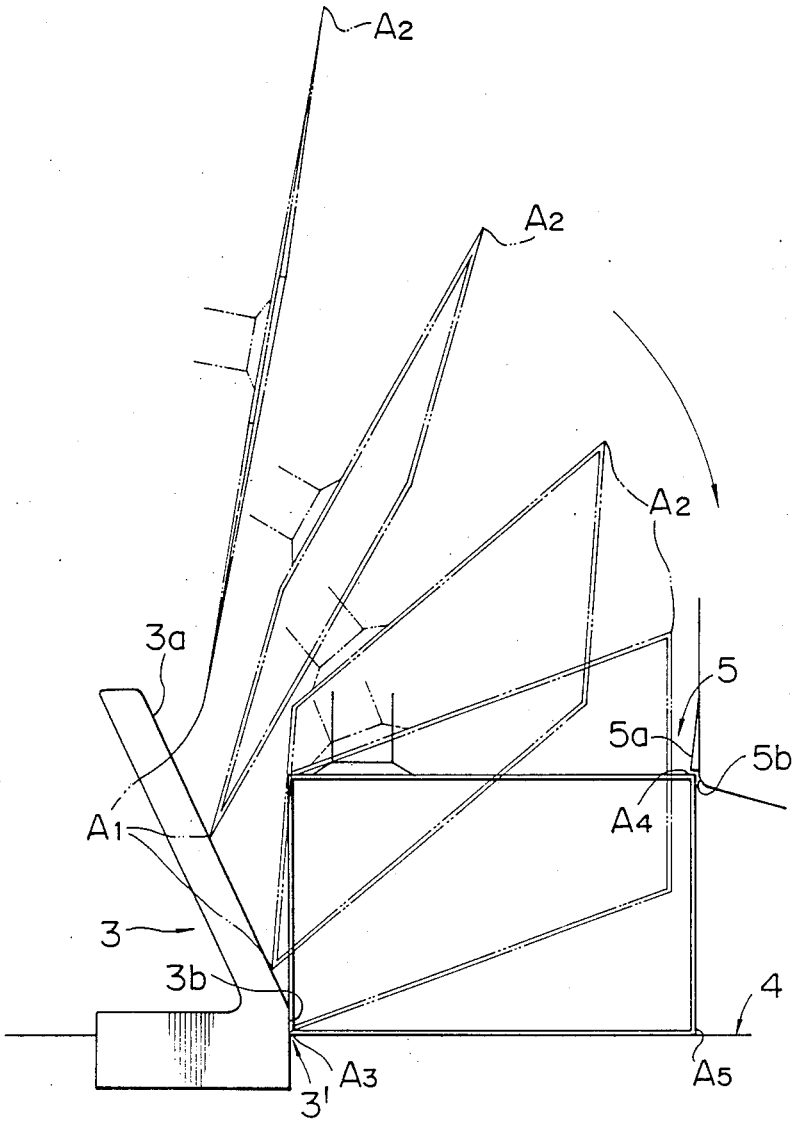
FIG. 9 is a schematic view showing a gradually opening state of a carton in sliding pressure contact with a fixed, inclined guide.

When the carton A approaches the lower vertex portion of the said hypotrochoid path, one folded edge $A_1$ of the carton A comes into sliding pressure contact with the inclined surfaces 3a,3a of the fixed, inclined guides 3,3. And, as shown in FIG. 9, with downward movement of the carton A, one folded edge $A_1$ is gradually pushed inwards of the carton A to unfold the carton.

As one folded edge $A_1$ of the carton A being unfolded gradually goes down along the vertical surfaces 3b,3b and the lower surface of the carton A approaches the upper surface of the conveyance path 4, the other folded edge $A_2$ causes the holding pawls 5a,5a of the upper stoppers 5,5 to swing and pass outside the moving path of the edge $A_2$, to give a square shape.

The opposed folding-side corner portions $A_3$ and $A_4$ of the thus squarely unfolded carton A are held immovably between the lower stoppers 3',3' comprising the vertical surfaces 3b,3b and the upper surface of the conveyance path 4 and the upper stoppers 5,5 comprising the lower surfaces of the holding pawls 5a,5a and the vertical surfaces 5b,5b. Consequently, the carton A is held in a square shape by utilizing its reaction force acting in the returning direction or the folding direction. At this time, the suction of the suction cup 2a is released.

Figure 10:
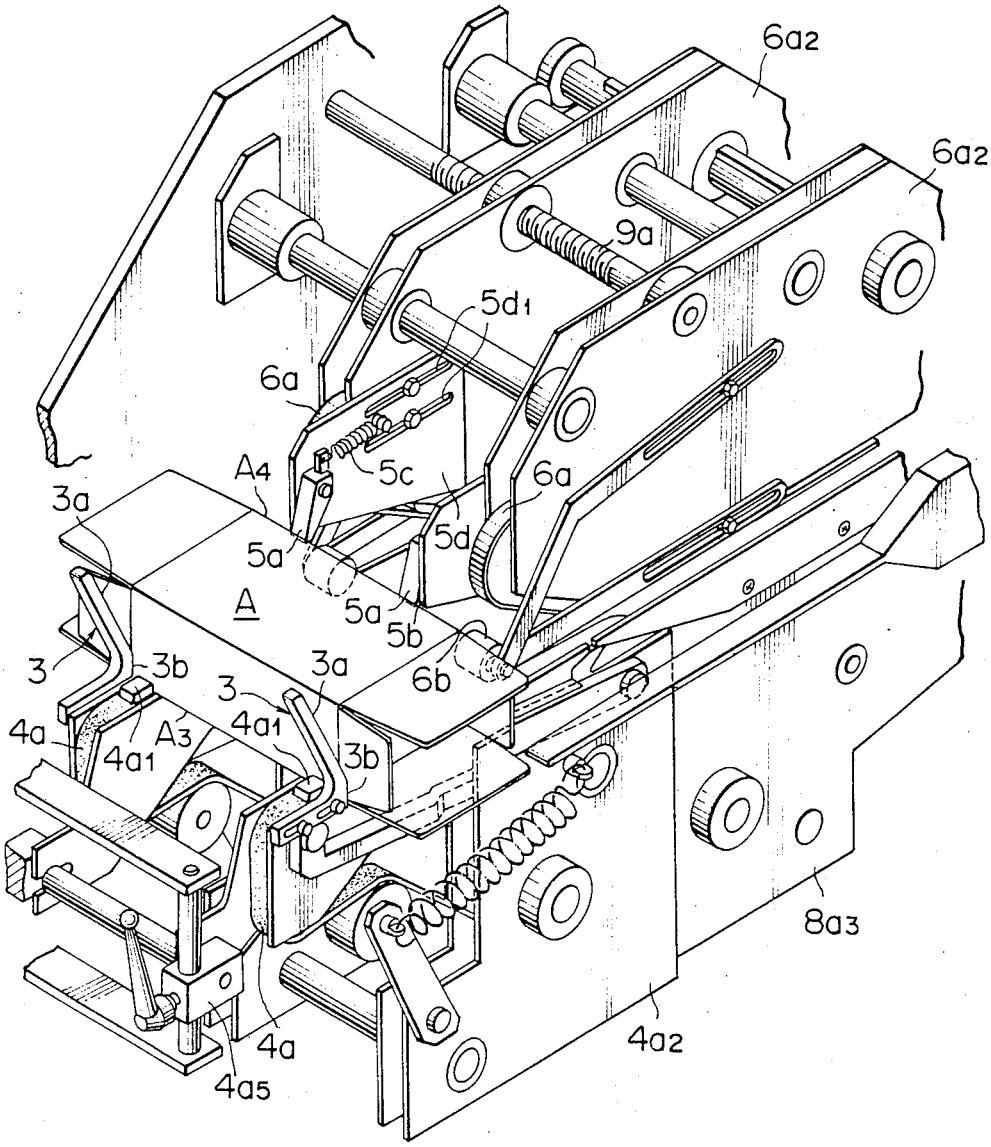
FIG. 10 is an enlarged perspective view of a principal portion, showing a carton held in an unfolded state.
Figure 11:
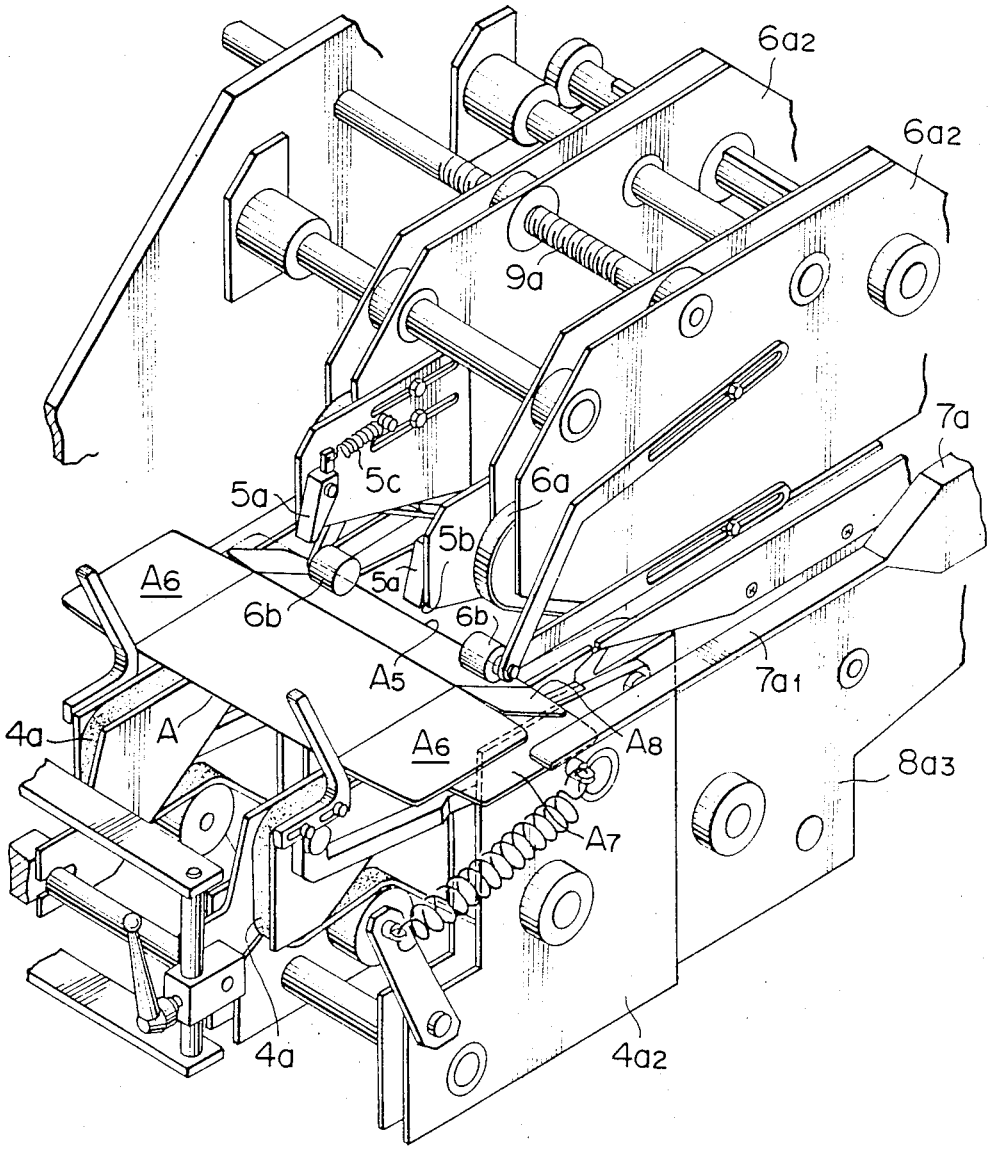
FIG. 11 is an enlarged perspective view of a principal portion, showing a state in which reversefolding folding was started.
Figure 12:
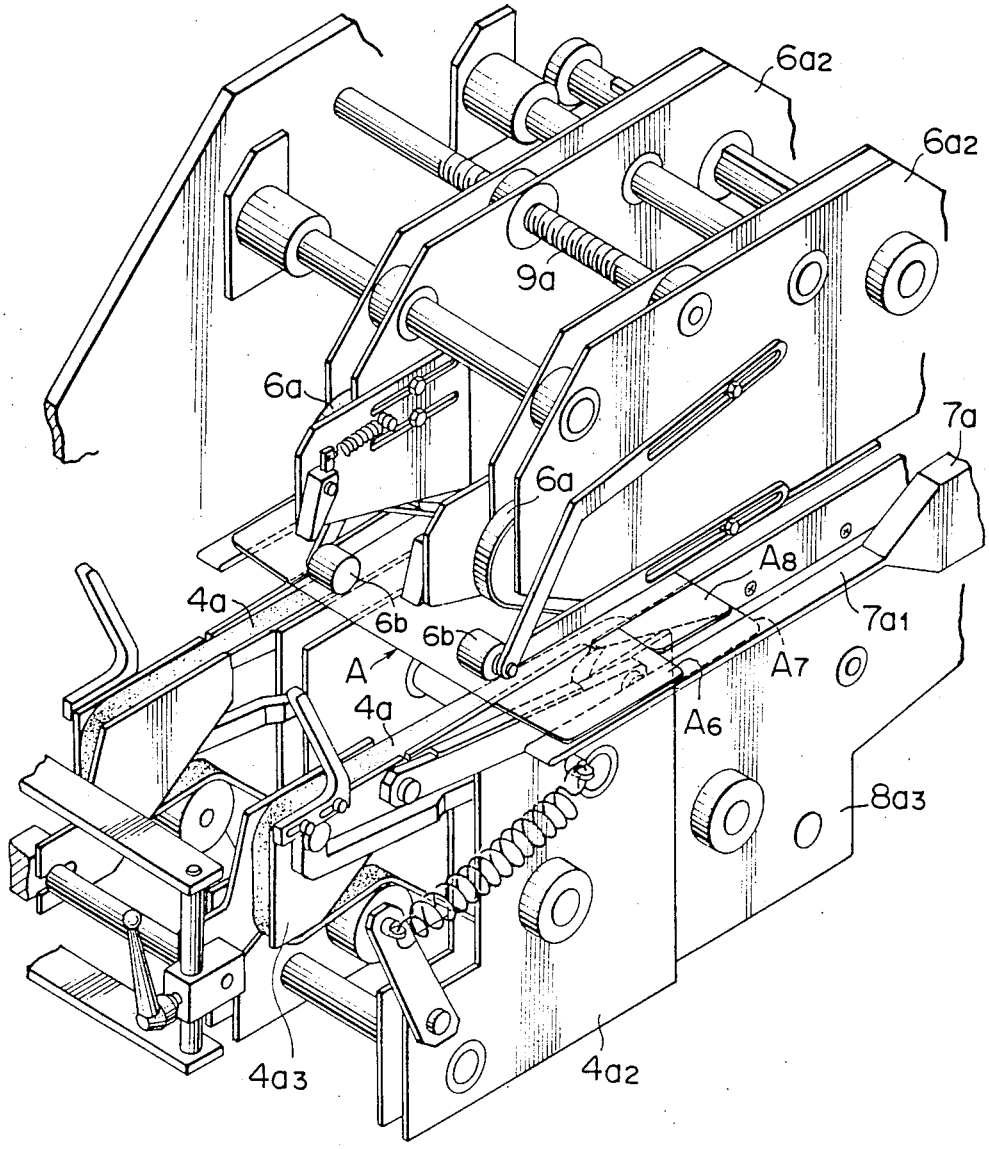
FIGS. 12 and 13 are enlarged perspective views of a principal portion, showing a completely reversefolded state of a carton.
Figure 13:
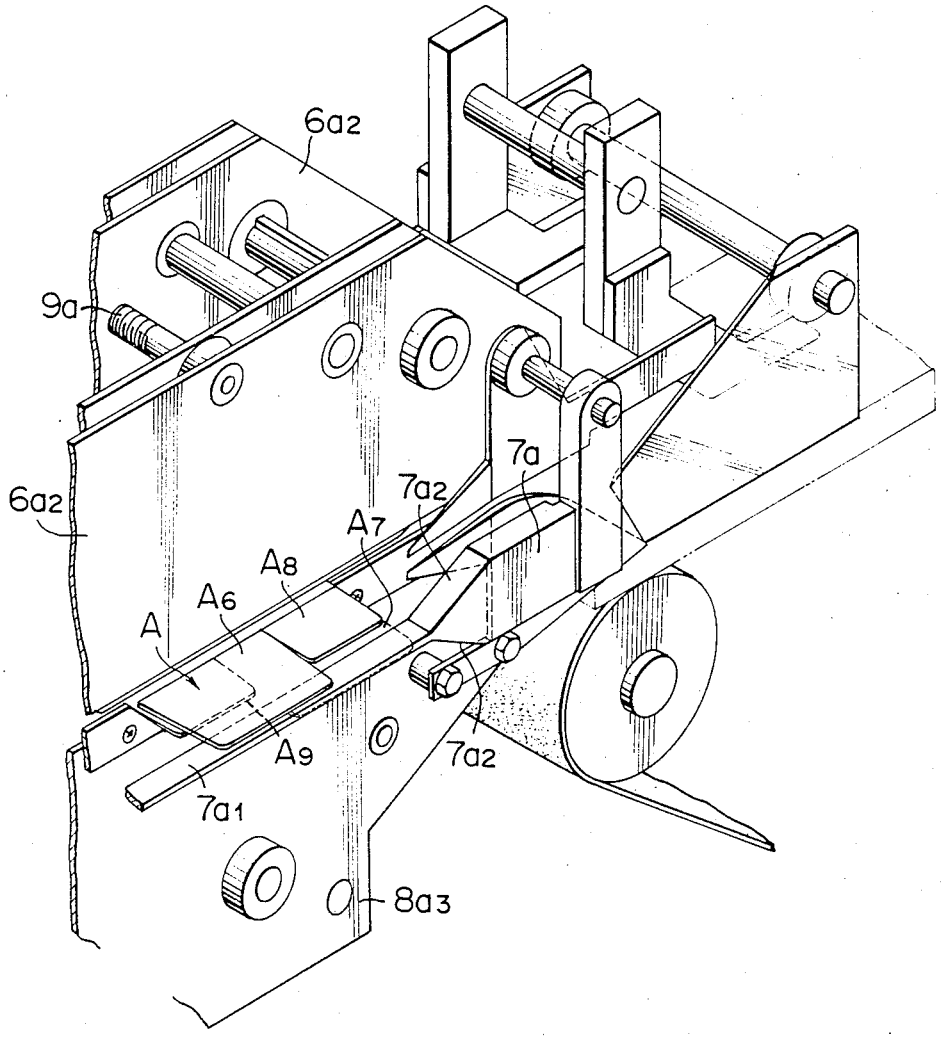
Figure 14:
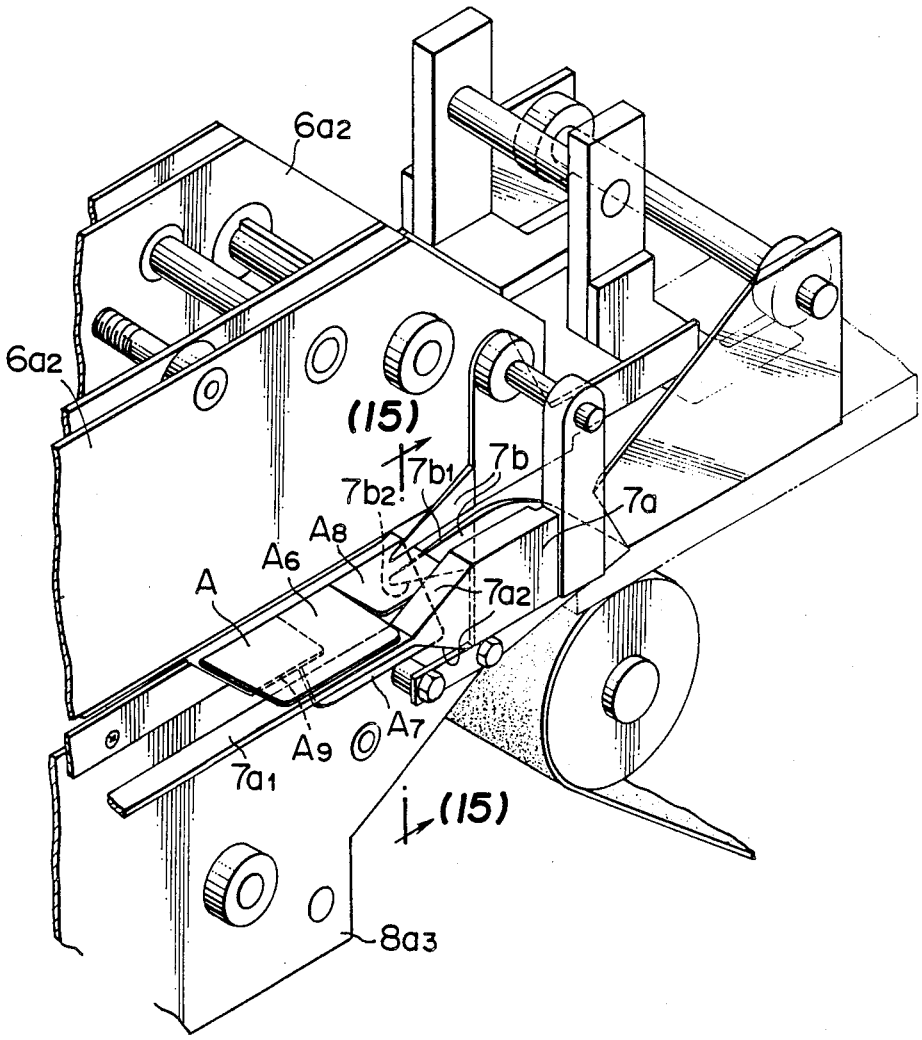
FIG. 14 is an enlarged perspective view of a principal portion, with a guide member inserted between upper and lower flaps of a reverse-folded carton.
Figure 15:
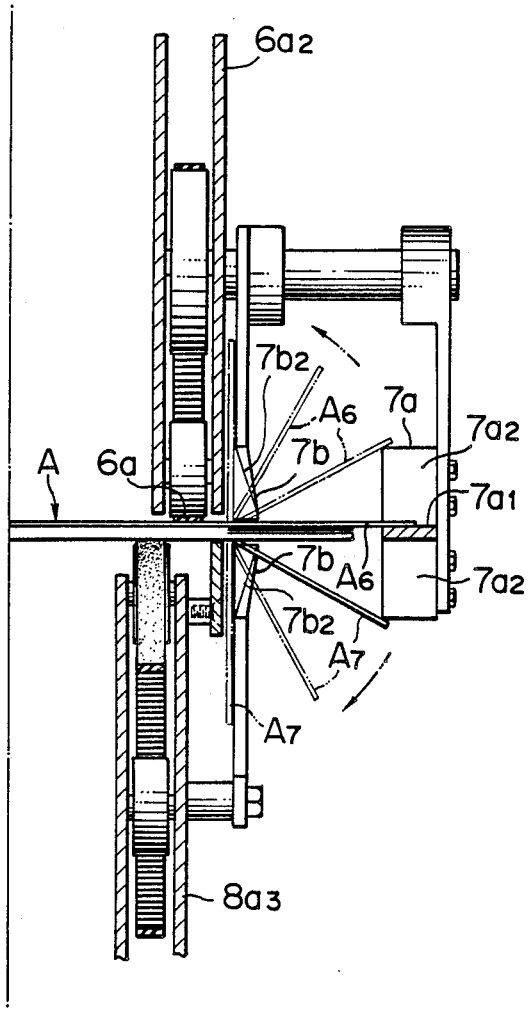
FIG. 15 an enlarged sectional view taken along line (15)—(15) of FIG. 14.
Figure 16:
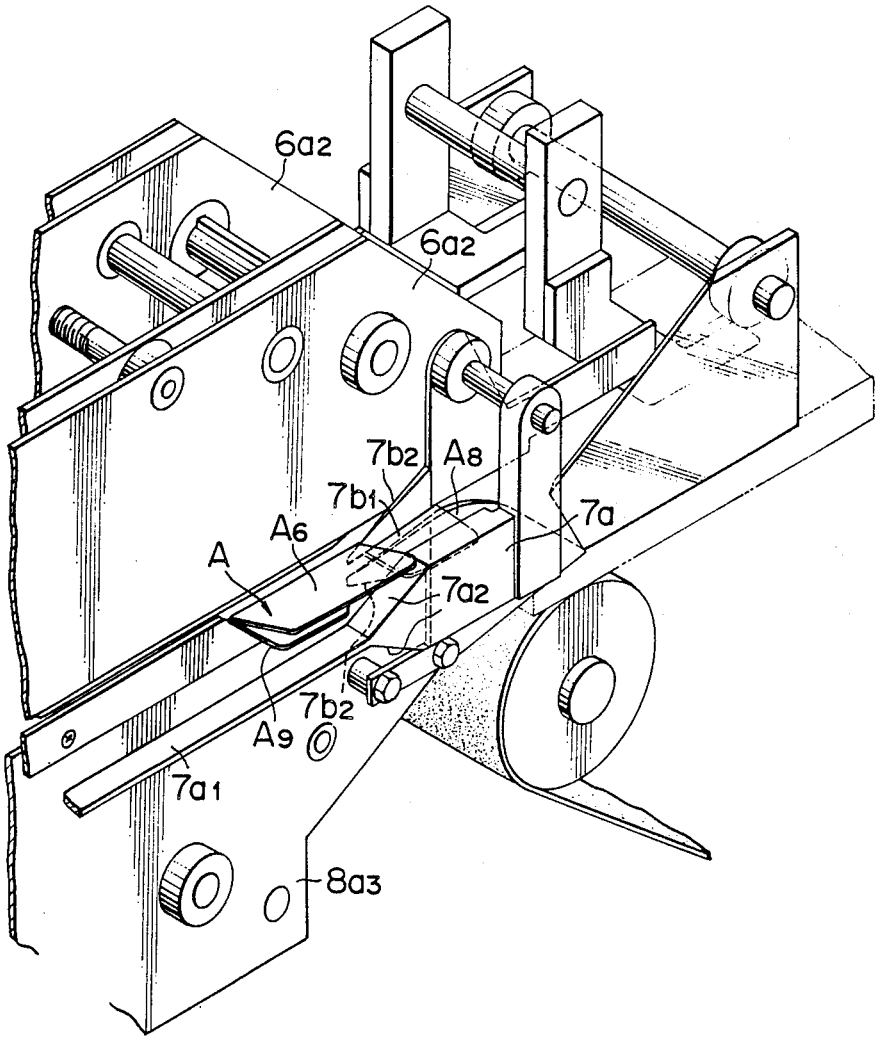
FIG. 16 is an enlarged perspective view of a principal portion, with upper and lower flaps expanded by the guide member.
Figure 17:
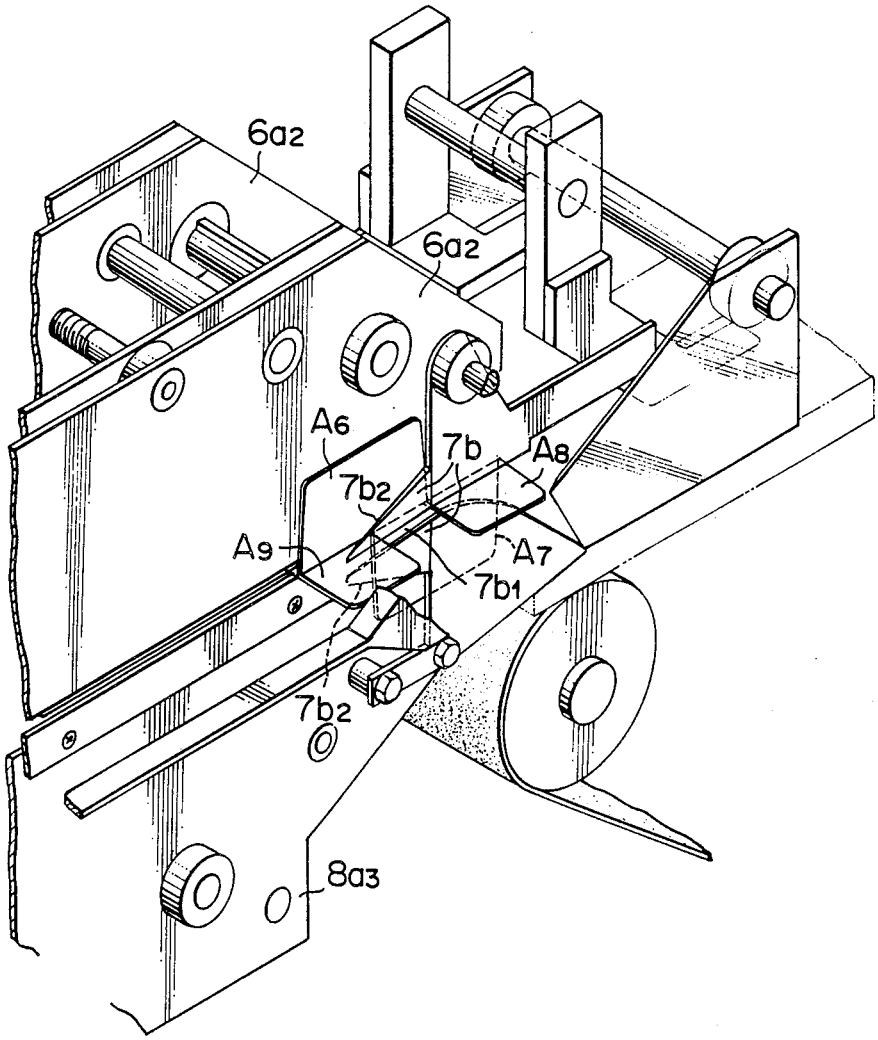
FIG. 17 is an enlarged perspective view of a principal portion, with upper and lower flaps enfolded approximately orthogonally by means of an upper and lower flap enfolding plate.

Thereafter, as shown in FIG. 10, only the lower surface side of the carton A is moved forward by operation of the transfer conveyors 4a,4a while the front upper end of the carton A is kept forwardly immovable by the vertical surfaces 5b,5b of the upper stoppers 5,5, whereby the carton A is gradually reversefolded so that the folding-side corner portions $A_3$ and $A_4$ approach each other. As shown in FIG. 11, the lower corner portion $A_5$ on the front side of the carton A is pressed flatwise by the squeezing rollers 6b,6b which constitute the reverse-folding means 6, and thereafter the carton is conveyed by the reverse-folding belt conveyors 6a,6a. Alternatively, as shown in FIGS. 12 and 13, the carton A is conveyed to between the lower end faces of the conveyors 6a,6a and the upper surface of the conveyance path 4 directly by means of only the reverse-folding conveyors 6a,6a and is thereby reversefolded at an angle of 180°.

Figure 18:
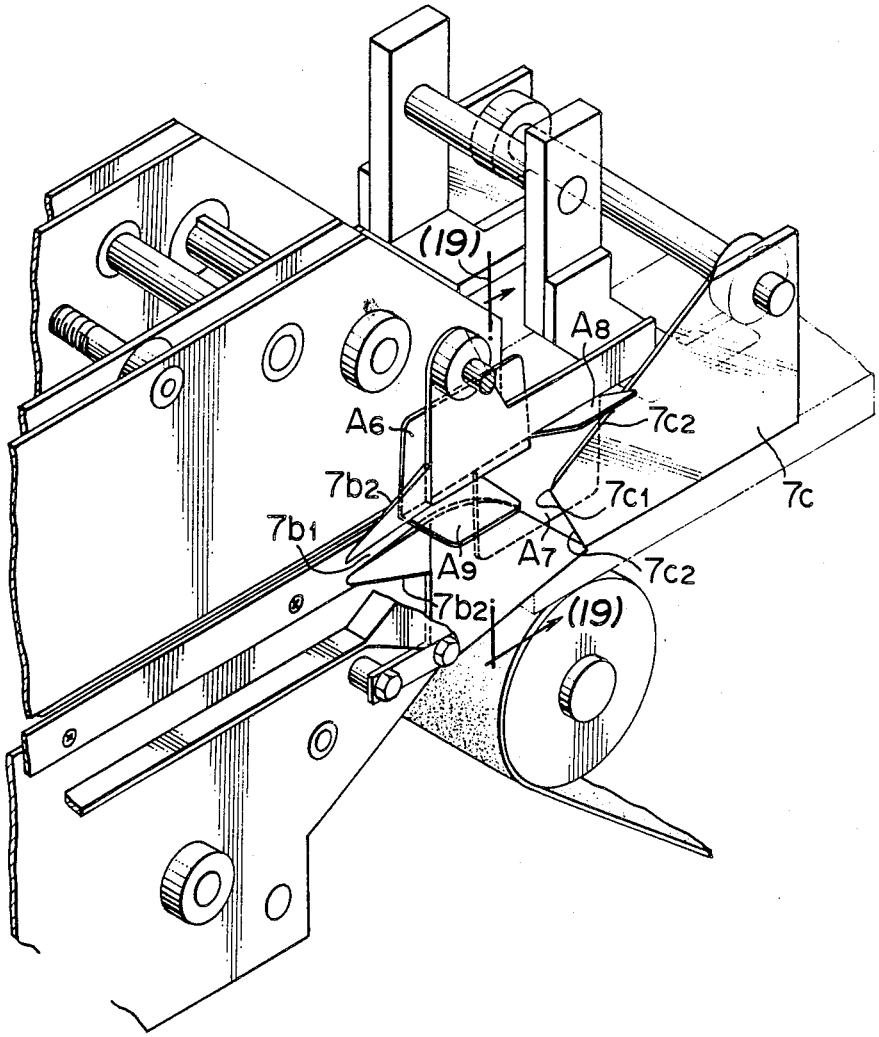
FIG. 18 is an enlarged perspective view of a principal portion, with a front flap expanded by means of a front and rear flap enfolding plate.
Figure 19:
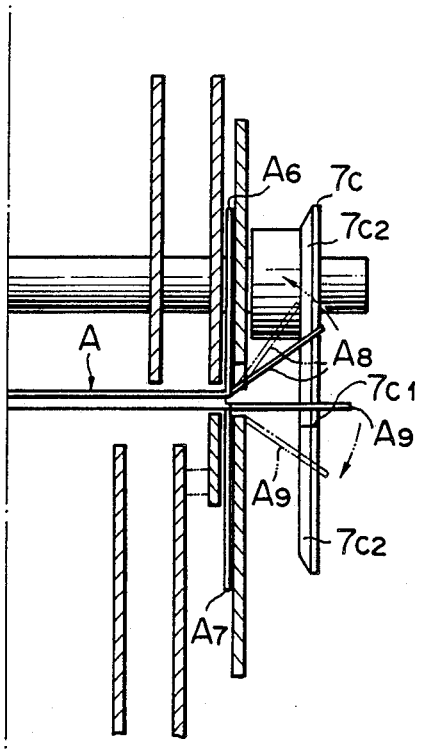
FIG. 19 is an enlarged sectional view taken on line (19)—(19) of FIG. 18.
Figure 20:
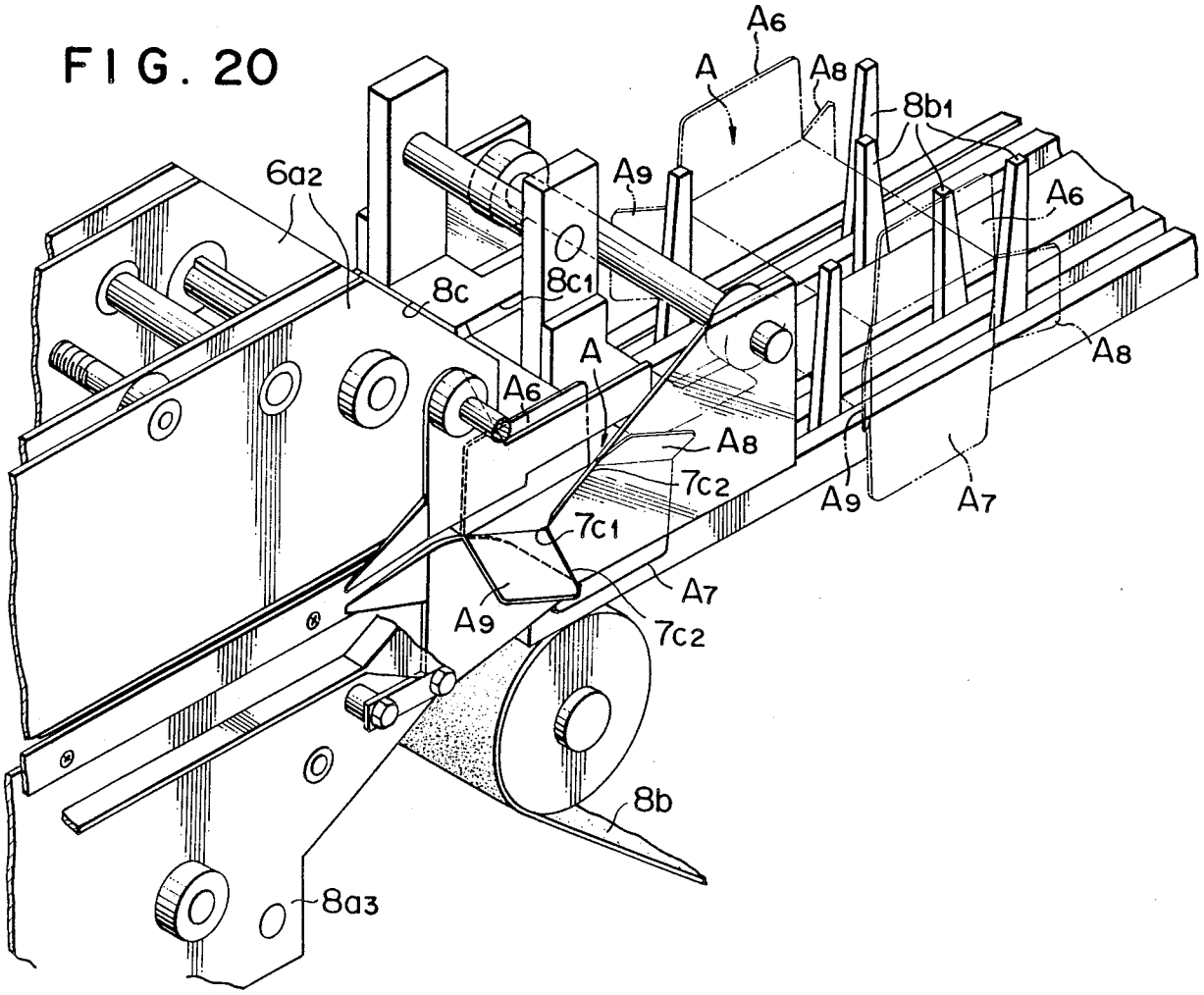
FIG. 20 is an enlarged perspective view of a principal portion, with a rear flap expanded by the front and rear flap enfolding plate.
Figure 21:
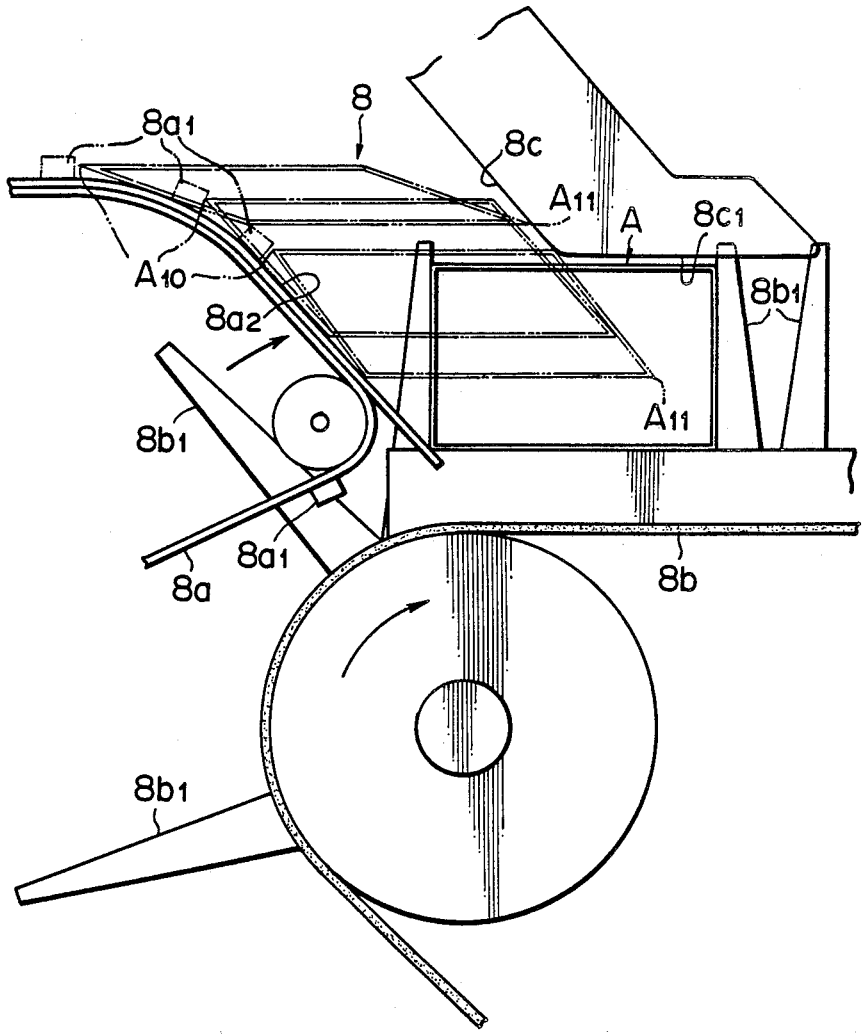
FIG. 21 is an enlarged perspective view of a principal portion, with a reverse-folded carton being squarely unfolded again.

The upper and lower flaps $A_6$,$A_6$, $A_7$,$A_7$ 180° reverse-folded carton A are vertically expanded and enfolded at an angle of 90° by the guide members 7a,7a and the upper and lower flap enfolding plates 7b,7b, which constitute the flap folding means 7, as shown in FIGS. 14 to 17. Likewise, the front and rear flaps $A_8$,$A_8$, $A_9$, $A_9$ are so expanded and enfolded by the front and rear flap enfolding plates 7c,7c as shown in FIGS. 18 to 20. Thereafter, as shown in FIG. 21, the carton A is compressed in the conveyance direction and again unfolded squarely by the projections 8a,8a of the reunfolding conveyors 8a,8a and the conveyance pawls $8b_1$,8b of the discharge conveyors 8b,8b, then conveyed to the encasing machine (not shown) while being held between the conveyance pawls 8b,$8b_1$ of the discharge conveyors 8b,8b.

On the other hand, in the case of change in size of the carton A, that is, in the case of change in vertical height, front-to-rear width or right-to-left length of the carton, the following adjustment is made.

Figure 22:
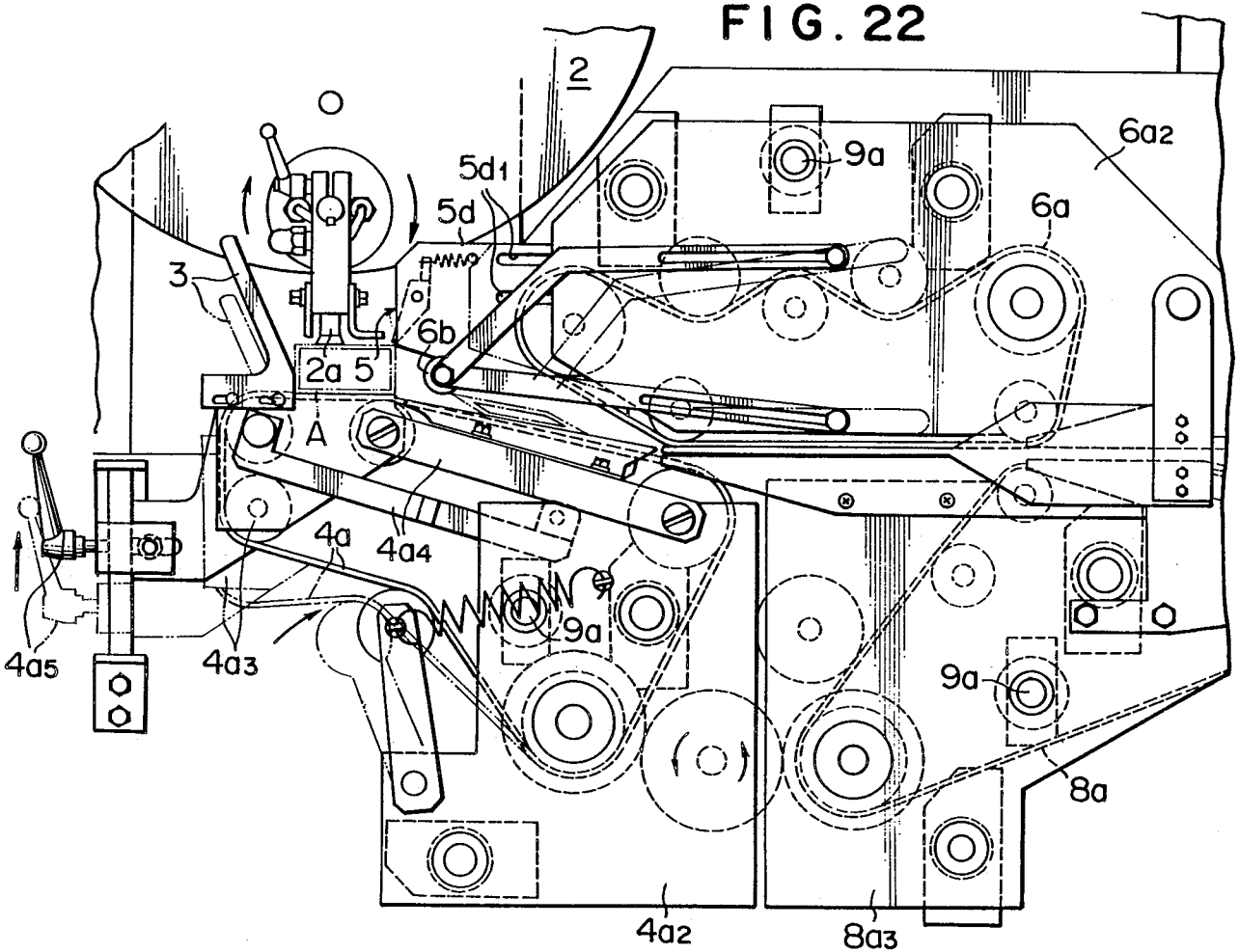
FIG. 22 is a side view of a principal portion, showing a state in which a rear half portion of conveyance means was vertically moved in response to a change in height of a carton.
Figure 23:
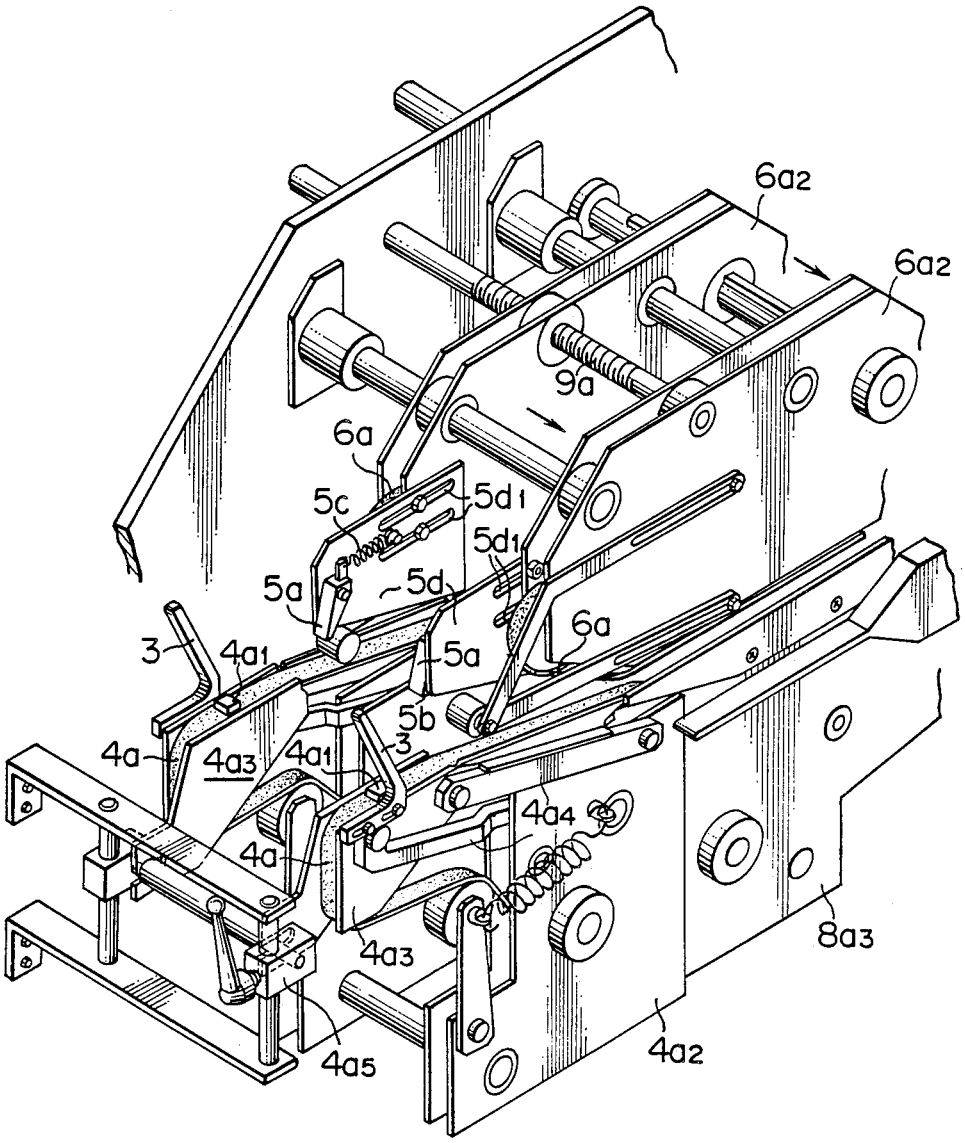
FIG. 23 is an enlarged perspective view thereof.

First, in the case of change in height of the carton A, as shown in FIGS. 22 and 23, the fixing handle $4a_5$ is released to let the rear support portions $4a_3$4$a_3$ move vertically in a horizontal state with respect to the front support portions $4a_2$,4$a_2$, to thereby adjust the height from the rear upper surfaces of the transfer conveyors 4a,4a up to the holding pawls 5a,5a of the upper stoppers 5,5. At the same time, the right and left, fixed, inclined guides 3,3 are moved forward or backward for adjustment. Also, the inclined plates 8c,8c are moved forward or backward and up or down to make adjustment and the projecting positions of the projections $8a_1$,$8a_1$ of the reunfolding conveyors 8a,8a are shifted forward or backward to adjust the timing between the front ends of the reunfolding conveyors 8a,8a and the conveyance pawls $8b_1$,8b of the discharge conveyors 8b,8b.

If necessary, moreover, the squeezing rollers 6b,6b are adjusted in their vertical position.

In the case of change in width of the carton A, the mounting plates 5d,5d of the upper stoppers 5,5 are moved forward or backward with respect to the support portions $6a_2$,$6a_2$ of the reverse-folding conveyors 6a,6a along the elongated apertures 5d,5d to thereby adjust the width from the vertical surfaces 3b,3b of the lower stoppers 3',3' to the vertical surfaces 5b,5b of the upper stoppers 5,5, and the inclined plates 8c,8c are moved forward or backward to make adjustment. Further, the projecting positions of the projections 8a,8a of the reunfolding conveyors 8a,8a are shifted forward and backward to adjust the timing with the conveyance pawls $8b_1$,$8b_1$ and the spacing between the conveyance pawls 8b,8b of the discharge conveyors 8b,8b is adjusted. If necessary, the squeezing rollers 6b,6b are adjusted positionally in the front and rear direction.

In the case of change in length of the carton B, the adjusting motor 9b is rotated forward or reverse to adjust the right-left spacings of the right and left transfer conveyors 4a,4a, the reverse-folding conveyors 6a,6a and the reunfolding conveyors 8a,8a and also adjust the right-left spacings of the right and left guide members 7a,7a the upper and lower flap enfolding plates 7b,7b and the front and rear flap enfolding plates 7c,7c. Also adjusted are the right-left spacings of the right and left, fixed, inclined guides 3,3 as well as the upper and lower stoppers 3',3', 5,5.

Figure 24:
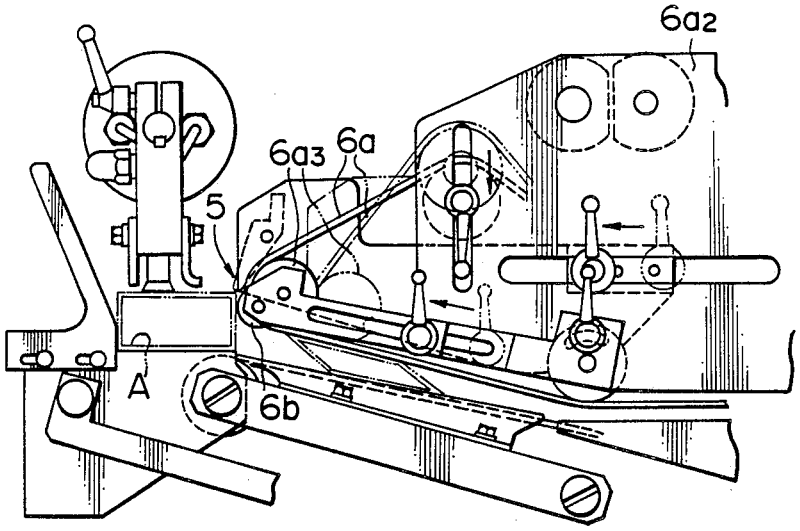
FIG. 24 is a side view of a carton assembling equipment according to another embodiment of the present invention, showing only a principal portion.
Figure 25:
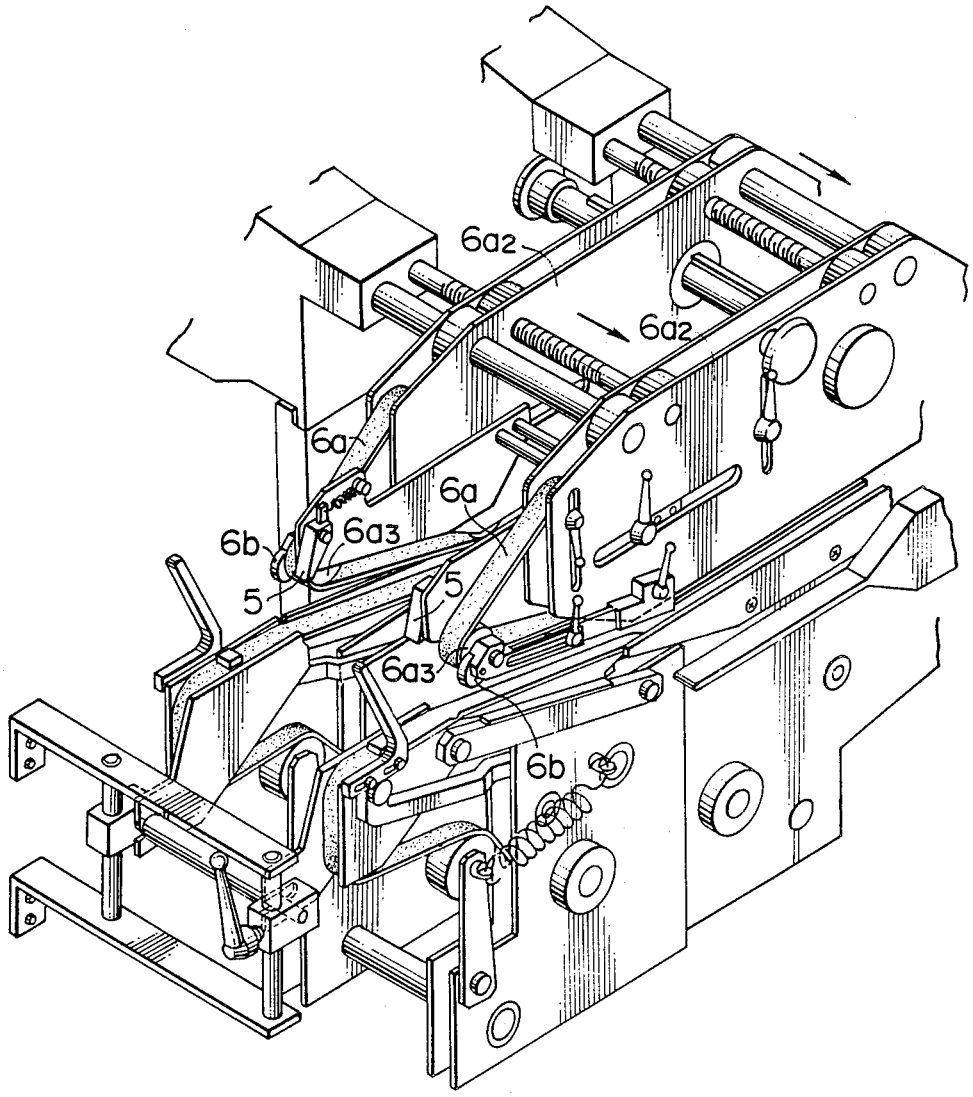
FIG. 25 is an enlarged perspective view thereof.

Although in the above embodiment the fixed, inclined guides 3 as well as the upper and lower stoppers 3',5 are respectively provided right and left in a pair, this arrangement does not constitute any limitation. They may be each provided one centrally in the right and left direction. Further, although each upper stopper 5 is attached to the support portion 6a: of the reverse-folding belt 6a also as to be movable forward and backward to cope with changes in width of the carton A, the arrangement for adjustment is not limited thereto. For example, as shown in FIGS. 24 and 25, the driven pulley $6a_3$ of the belt 6a, the upper stopper 5 and the squeezing roller 6b may be attached to the support portion $6a_2$ of the reverse-folding belt 6a so as to be movable forward and backward, to thereby adjust them simultaneously. Further, although in the above embodiment the right and left flaps are expanded simultaneously by the flap folding means 7, this is not a limitation. Only the flaps on the contents charging side may be expanded.

We claim:

1. A carton assembling method comprising the steps of separately removing flatwise folded cartons as individual cartons having a folded edge from a magazine; unfolding each of the individual cartons to form an unfolded carton while transferring the individual cartons downward along a rotative path, wherein the unfolding of each of the individual cartons comprises bringing the folded edge of the carton being transferred downward along the rotative path into sliding pressure contact with a fixed, inclined guide of a series of guides which gradually approach a path of movement of the folded edge of the carton, which as a result of the downward rotative path and the sliding pressure contact with the inclined guides, gradually causes the unfolding of the carton; holding a pair of opposed folding-side corner portions on each opening side of the unfolded carton squarely between a pair of stoppers; moving the carton in a direction in which both pair of folding-side corner portions approach each other to reverse-fold the carton; approximately orthogonally expanding and enfolding flaps of the reverse-folded carton; and then squarely unfolding the carton;

2. A carton assembling apparatus comprising a magazine wherein a number of flatwise folded cartons are stacked, a rotative transfer mechanism having suction cups attached to a front end; a conveyance mechanism disposed along a horizontal conveyance path; fixed, inclined guides erected on said conveyance path so as to gradually approach a path of movement of a folded edge of each carton; lower stoppers having a vertical surface formed below and contiguously to an inclined surface of each of said fixed, inclined guides which are adapted to engage foldingside corner portions of a surface of said carton which is disposed above said conveyance path; means for reverse-folding disposed in front of upper stoppers on said conveyance path, said upper stoppers having a height from the upper surface of said conveyance path which is lower in a forward direction, wherein a pair of opposed folding side corner portions on each side of the unfolded carton are held squarely between said upper and lower stoppers; and means for compressing a reverse-folded carton in a front and rear direction, whereby said cartons are removed individually from said magazine by said suction cups and unfolded squarely on a conveyance path of aid conveyance mechanism while being transferred downward along said conveyance path.

3. A carton assembling method comprising the steps of separately removing flatwise, folded cartons as individual cartons having a folded edge from a magazine; and unfolding each of the cartons to form an unfolded carton while transferring the individual cartons downward along a rotative path, wherein the unfolding of each of the individual cartons comprises bringing the folded edge of the carton being transferred downward along the rotative path into sliding pressure contact with a fixed, inclined guide of a series of guides which gradually approach the path of movement of the folded edge of the carton gradually unfolding the carton; holding a pair of opposed, folding-side corner portions on each opening side of the unfolded carton squarely between a pair of stoppers; moving the carton in a direction in which both of the folding-side corner portions approach each other to reverse-fold the carton at an angle of 180 degrees; expanding and enfolding flaps of the reverse-folded carton approximately orthogonally; and thereafter squarely unfolding the carton.

4. A carton assembling apparatus comprising a magazine wherein a number of flatwise folded cartons are stacked; a rotative transfer mechanism having suction cups attached to a front end for withdrawing said cartons from said magazine; a conveyance mechanism disposed along a horizontal conveyance path; fixed, inclined guides erected on said conveyance path so as to gradually approach a path of movement of a folded edge of each of the individual cartons; lower stoppers having a vertical surface disposed below and contiguously to said fixed, inclined guides; upper stoppers adapted to engage folding-side corner portions of an upper surface of said carton disposed above said conveyance path wherein a pair of opposed folding side corner portions on each side of the unfolded carton are held squarely between said upper and lower stoppers means for reverse-folding said carton disposed in front of said upper stoppers on said conveyance path, said upper stoppers having a height from the upper surface of said conveyance path which is lower in the forward direction; means for expanding and enfolding abutting flaps of said reverse-folded carton approximately orthogonally; and means for compressing a reverse-folded carton in a front and rear direction.

5. A carton assembling apparatus, comprising:

(a) a magazine containing a number of stacked, flatwise folded cartons;

(b) a substantially circular rotative transfer mechanism having:

(i) suction cups attached to a front end, and (ii) plural planetary gear trains meshing with a fixed gear connected to a drive source, said suction cups being attached to outer-end gears of said planetary gear trains, said suction cups moving along a hypotrochoid path by rotation of said planetary gear trains along an outer periphery of said fixed gear;

(c) a conveyance mechanism disposed along a horizontal conveyance path of said apparatus, having:

(i) fixed inclined guides erected on said horizontal conveyance path so as to gradually approach the path of movement of a folded edge of each carton;

(ii) lower stoppers disposed below and contiguous to said fixed, inclined guides;

(iii) upper stoppers adapted to engage folding-side corner portions of the upper surface of said carton disposed above said conveyance path;

(iv) means for reverse-folding said cartons that are disposed in front of said upper stoppers, wherein the height from upper surface of said conveyance path is lowered in the forward direction; and (v) means for compressing a reverse-folded carton in a front and rear direction, whereby said cartons are individually removed from said magazine by said suction cups, and then unfolded squarely on said conveyance mechanism while being transferred downward along said conveyance path, wherein said lower stoppers comprise a vertical surface formed below and contiguously to an inclined surface of each of said fixed, inclined guides and an upper surface of said horizontal conveyance path, said upper stoppers comprising a holding pawl disposed in a path of movement of the folded edge of each carton, opposed to an upper surface of said carton in an unfolded state and a vertical surface erected in opposition to a front face of said unfolded carton.

6. A carton assembling apparatus according to claim 5, wherein said conveyance mechanism comprises a belt conveyer adapted to move in a predetermined conveyance direction having at least four substantially long and rectangular outward projections disposed at substantially equal intervals to maintain said cartons position on each said corner, along said conveyance mechanism, said cartons being conveyed by driving said projections.

7. A carton assembling apparatus, comprising:

(a) a magazine containing a number of stacked, flatwise folded cartons;

(b) a substantially circular rotative transfer mechanism having:

(b) a substantially circular rotative transfer mechanism having:

(i) suction cups attached to a front end, and (ii) plural planetary gear trains meshing with a fixed gear connected to a drive source, said suction cups being attached to outer-end gears of said planetary gear trains, said suction cups moving along a hypotrochoid path by rotation of said planetary gear trains along an outer periphery of said fixed gear;

(c) a conveyance mechanism disposed along a horizontal conveyance path of said apparatus, having:

(i) fixed inclined guides erected on said horizontal conveyance path so as to gradually approach the path of movement of a folded edge of each carton;

(ii) lower stoppers disposed below and contiguous to said fixed, inclined guides;

(iii) upper stoppers adapted to engage folding-side corner portions of the upper surface of said carton disposed above said conveyance path;

(iv) means for reverse-folding said cartons that are disposed in front of said upper stoppers, wherein the height from upper surface of said conveyance path is lowered in the forward direction; and (y) means for compressing a reverse-folded carton in a front and rear direction, whereby said cartons are individually removed from said magazine by said suction cups, and then unfolded squarely on said conveyance mechanism while being transferred downward along said conveyance path, wherein said means for reverse-folding comprises a belt conveyor having a plurality of outward projections disposed at substantially equal intervals and a rear end, with respect to the conveyance direction, which is inclined forwardly and downwardly in the conveyance direction, said cartons being reverse-folded while being conveyed forward by said outward projections.

8. A carton assembling apparatus, comprising:

(a) a magazine containing a number of stacked, flatwise folded cartons;

(b) a substantially circular rotative transfer mechanism having:

(i) suction cups attached to a front end, and (ii) plural planetary gear trains meshing with a fixed gear connected to a drive source, said suction cups being attached to outer-end gears of said planetary gear trains, said suction cups moving along a hypotrochoid path by rotation of said planetary gear trains along an outer periphery of said fixed gear;

(c) a conveyance mechanism disposed along a horizontal conveyance path of aid apparatus, having:

(i) fixed inclined guides erected on said horizontal conveyance path so as to gradually approach the path of movement (ii) lower stoppers disposed below and contiguous to said fixed, inclined guides;

(iii) upper stoppers adapted to engage folding-side corner portions of the upper surface of said carton disposed above said conveyance path;

(iv) means for reverse-folding said cartons that are disposed in front of said upper stoppers, wherein the height from upper surface of said conveyance path is lowered in the forward direction; and (v) means for compressing a reverse-folded carton in a front and rear direction, whereby said cartons are individually removed from said magazine by said suction cups, and then unfolded squarely on said conveyance mechanism while being transferred downward along said conveyance path, wherein said means for compressing comprises a belt conveyor having a plurality of outward projections formed at substantially equal intervals and a discharge conveyor disposed at a falling distance from a downwardly curved surface formed at a front end in the conveyance direction of said belt conveyor, said discharge conveyor having a plurality of conveyance pawls erected at substantially equal intervals, each corresponding to a width of said carton, wherein said reverse-folded carton is conveyed forward and allowed to fall along a downwardly curved surface by operation of said outward projections and conveyance pawls while a front edge of said carton is brought into abutment with a horizontally moving conveyance pawl so as to compress said carton in a front and rear direction.

9. A carton assembling apparatus, comprising:

a magazine containing a number of stacked, flat-wise folded cartons;

a rotative transfer mechanism having suction cups attached to a front end;

a conveyance mechanism disposed along a substantially horizontal path of said apparatus;

fixed, inclined guides erected on said conveyance path of said conveyance mechanism so as to gradually approach a path of movement of a folded edge of the cartons;

lower stoppers disposed below and contiguously to said fixed, inclined guides;

upper stoppers which are engagable with folding side corners of an upper surface of the cartons disposed adjacent to said conveyance path;

reverse-folding means disposed in front of said upper stoppers whose height from an upper surface of said conveyance path is lower in the forward direction;

means for folding abutting flaps of the cartons and expanding said flaps approximately orthogonally, said means for flap folding having guide members for insertion between upper and lower flaps of the cartons to expand said flaps in a vertical direction, upper and lower flap enfolding plates for enfolding said expanded upper and lower flaps approximately orthogonally, and front and rear flap and enfolding plates for expanding and enfolding front and rear flaps approximately orthogonally, said guide members, upper and lower flap enfolding plates and front and rear flap enfolding plates being successfully disposed in a conveyance direction of said conveyance mechanism; and means for compressing a reverse-folded carton in a front and rear direction whereby said cartons are individually removed from said magazine by said suction cups and are squarely unfolded on said conveyance mechanism while being transferred downward along said conveyance path.

10. A carton assembling apparatus comprising:

a magazine containing a number of stacked, flatwise folded cartons;

a rotative transfer mechanism having suction cups attached to a front end;

a conveyance mechanism disposed along a substantially horizontal conveyance path of said apparatus, said conveyance mechanism including, a rear half portion positioned under said rotative transfer mechanism connected to a front half portion of said conveyance mechanism and being vertically movable through parallel moving members;

fixed, inclined guides erected on said rear half portion of said conveyance mechanism so as to gradually approach a path of movement of a folded edge of a carton, said fixed, inclined guides being forwardly and backwardly adjustable;

lower stoppers disposed below and contiguously to said fixed, inclined guides;

upper stoppers adapted to engage folding-side corner portions of an upper surface of said carton disposed above said conveyance path;

means for reverse-folding disposed in front of said upper stoppers whose height from the upper surface of said conveyance path is lower in the forward direction; and means for compressing a reverse-folded carton in a front and rear direction, said upper stoppers and means for compressing being mounted so that a compressing distance in said front and rear direction can be adjusted, said reverse-folding means and said compressing means being constructed so that a right-to-left dimension thereof can be adjusted to the size of said carton whereby said cartons are individually removed from said magazine by said suction cups and unfolded squarely on said conveyance path of said conveyance mechanism while being transferred along a rotative path for further processing.

11. A carton assembling apparatus, comprising:

a magazine containing a number of stacked, flatwise folded cartons;

a rotative transfer mechanism having suction cups attached to a front end;

a conveyance mechanism disposed along a substantially horizontal conveyance path, said conveyance mechanism having:

(i) a rear half portion; and (ii) a front half portion, said rear half portion of said conveyance mechanism positioned under rotative transfer mechanism being connected to a front half portion and being vertically movable through parallel moving members;

fixed inclined guides erected on said conveyance path so as to gradually approach a path of movement of a folded edge of each carton, said fixed inclined guides being erected on said rear half portion of said conveyance mechanism so as to be forwardly and backwardly adjustable;

lower stoppers disposed below and contiguously to said fixed inclined guides;

upper stoppers adapted to engage folding-side corner portions of an upper surface of said carton disposed above said conveyance path;

means for reverse-folding disposed in front of said upper stoppers in the conveyance direction of said conveyance mechanism, wherein a height of said means for reverse-folding from the upper surface of the conveyance path is lower in the forward direction;

means for folding abutting flaps of said carton and expanding said flaps approximately orthogonally; and means for compressing a reverse-folded carton in a front and rear direction, said upper stoppers and compressing means being mounted so that a compressing distance in said front and rear directions can be adjusted, said means for reverse folding, flap folding means and compressing means being constructed so that a transverse dimension thereof can be adjusted to match the size of said carton whereby said cartons are individually removed from said magazine by said suction cups and unfolded squarely on said conveyance path of said conveyance mechanism while being transferred downward along said conveyance path.

12. A carton assembling apparatus, comprising:

a magazine containing a number of stacked, flatwise folded cartons;

a rotative transfer mechanism having:

(i) suction cups attached proximate a front end of said rotative transfer mechanism, and (ii) plural planetary gear trains meshing with a fixed gear connected to a drive source, said suction cups being attached to outer-end gears of said planetary gear trains, said suction cups moving along a hypotrochoid path by rotation of said planetary gear trains along an outer periphery of said fixed gear;

a conveyance mechanism disposed along a horizontal conveyance path of said apparatus, having:

fixed inclined guides erected on said horizontal conveyance path so as to gradually approach a path of movement of a folded edge of each individual carton;

lower stoppers disposed below and contiguous to said fixed, inclined guides;

upper stoppers adapted to engaged folding-side corner portions of an upper surface of said carton disposed above said conveyance path;

means for reverse-folding said cartons that are disposed in front of said upper stoppers, wherein the height from the upper surface of said conveyance path is lower in the forward direction; and means for compressing a reverse-folded carton in a front and rear direction, whereby said cartons are individually removed from said magazine by said suction cups, and then unfolded squarely on said conveyance mechanism while being transferred downward along said conveyance path wherein said lower stoppers comprise a vertical surface formed below and contiguously to an inclined surface of each of said fixed, inclined guides and an upper surface of said horizontal conveyance path, said upper stoppers comprising a holding pawl disposed in a path of movement of the folded edge of each carton, opposed to an upper surface of said carton in an unfolded state and a vertical surface erected in opposition to a front face of said unfolded carton.

13. A carton assembling apparatus, comprising:

a magazine containing a number of stacked, flatwise folded cartons;

a rotative transfer mechanism having:

(i) suction cups attached proximate a front end of said rotative transfer mechanism, and (ii) plural planetary gear trains meshing with a fixed gear connected to a drive source, said suction cups being attached to outer-end gears of said planetary gear trains, said suction cups moving along a hypotrochoid path by rotation of said planetary gear trains along an outer periphery of said fixed gear;

a conveyance mechanism disposed along a horizontal conveyance path of said apparatus, having:

fixed inclined guides erected on said horizontal conveyance path so as to gradually approach a path of movement of a folded edge of each individual carton;

lower stoppers disposed below and contiguous to said fixed, inclined guides;

upper stoppers adapted to engage folding-side corner portions of an upper surface of said carton disposed above said conveyance path;

means for reverse-folding said cartons that are disposed in front of said upper stoppers, wherein the height from the upper surface of said conveyance path is lower in the forward direction; and means for compressing a reverse-folded carton in a front and rear direction, whereby said cartons are individually removed from said magazine by said suction cups, and then unfolded squarely on said conveyance mechanism while being transferred downward along said conveyance path, wherein said means for reverse-folding comprises a belt conveyor having a plurality of outward projections disposed at substantially equal intervals and a rear end, with respect to the conveyance direction, which is inclined forwardly and downwardly in the conveyance direction, said cartons being reverse-folded while being conveyed forward by said outward projections.

14. A carton assembling apparatus, comprising:

a magazine containing a number of stacked, flatwise folded cartons;

a rotative transfer mechanism having:

(i) suction cups attached proximate a front end of said rotative transfer mechanism, and (ii) plural planetary gear trains meshing with a fixed gear connected to a drive source, said suction cups being attached to outer-end gears of said planetary gear trains, said suction cups moving along a hypotrochoid path by rotation of said planetary gear trains along an outer periphery of said fixed gear;

a conveyance mechanism disposed along a horizontal conveyance path of said apparatus, having:

fixed inclined guides erected on said horizontal conveyance path so as to gradually approach a path of movement of a folded edge of each individual carton;

lower stoppers disposed below and contiguous to said fixed, inclined guides;

upper stoppers adapted to engage folding-side corner portions of an upper surface of said carton disposed above said conveyance path;

means for reverse-folding said cartons that are disposed in front of said upper stoppers, wherein the height from the upper surface of said conveyance path is lower in the forward direction; and means for compressing a reverse-folded carton in a front and rear direction, whereby said cartons are individually removed from said magazine by said suction cups, and then unfolded squarely on said conveyance mechanism while being transferred downward along said conveyance path, wherein said means for compressing comprises a belt conveyor having a plurality of outward projections formed at substantially equal intervals and a discharge conveyor disposed at a falling distance from a downwardly curved surface formed at a front end in the conveyance direction of said belt conveyor, said discharge conveyor having a plurality of conveyance pawls erected at substantially equal intervals, each corresponding to a width of said carton, wherein said reverse-folded carton is conveyed forward and allowed to fall along a downwardly curved surface by operation of said outward projections and conveyance pawls while a front edge of said carton is brought into abutment with a horizontally moving conveyance pawl so as to compress said carton in a front and rear direction.

* * * * *

UNITED STATES PATENT AND TRADEMARK OFFICE

CERTIFICATE OF CORRECTION

PATENT NO. : 4,983,154

DATED : January 8, 1991

INVENTOR(S) : T. NAGAHASHI et al.

It is certified that error appears in the above-indentified patent and that said Letters Patent is hereby corrected as shown below:

At column 4, line 36 of the printed patent, change "reversefolding folding" to ---reverse-folding---.

At column 4, line 39 of the printed patent, change "reversefolded" to ---reverse-folded---.

At column 5, line 29 of the printed patent, change "A:" to ---$A_1$---.

At column 6, line 44 of the printed patent, change "5d" to ---$5d_1$---.

At column 6, line 48 of the printed patent, change "6i" to ---6a---.

At column 6, line 49 of the printed patent, change "5d" to ---$5d_1$---.

At column 7, line 8 of the printed patent, change "reversefolding" to ---reverse-folding---.

At column 7, line 31 of the printed patent, change "As and A" to ---$A_6$ and $A_7$---.

At column 7, line 48 of the printed patent, change "7ahd2" to ---$7a_2$---.

At column 7, line 66 of the printed patent, change "7b" to ---$7b_2$---.

At column 8, line 34 of the printed patent, change "8a" to ---$8a_1$---.

At column 8, line 56 of the printed patent, change "$8a_3$. which" to ---"$8a_3$, which---.

At column 8, line 62 of the printed patent, change "4a, $4a_2$" to ---$4a_2$, $4a_2$---.

UNITED STATES PATENT AND TRADEMARK OFFICE

CERTIFICATE OF CORRECTION

PATENT NO. : 4,983,154 Page 2 of 3

DATED : January 8, 1991

INVENTOR(S) : T. Nagahashi et al.

It is certified that error appears in the above-indentified patent and that said Letters Patent is hereby corrected as shown below:

At column 9, line 45 of the printed patent, change "reversefolded" to ---reverse-folded---.

At column 9, line 56 of the printed patent, change "reversefolded" to ---reverse-folded---.

At column 9, line 68 of the printed patent, change "8a, 8a" to --- $8a_1$, $8a_1$---.

At column 10, line 2 of the printed patent, change "$8b_1$, 8b" to $8b_1$, $8b_1$---.

At column 10, line 4 of the printed patent, change "$8b_1$, 8b" to --- $8b_1$, $8b_1$---.

At column 10, line 14 of the printed patent change "$4a_2$, 4a $_2$" to --- $4a_2$, $4a_2$---.

At column 10, line 25 of the printed patent change "$8b_1$, 8b" to --- $8b_1$, $8b_1$ --.

At column 10, line 38 of the printed patent, change "8a, 8a" to --- $8a_1$, $8a_1$---.

At column 10, line 62 of the printed patent, change "6a:" to $6a_2$--- .

At column 11, line 30 (claim 1, line 22) of the printed patent, change "carton;" to ---carton.---.

At column 11, line 41 (claim 2, line 11) of the printed patent, change "foldingside" to ---folding-side---.

At column 11, line 53 (claim 2, line 11) of the printed patent, change "aid" to ---said---.

UNITED STATES PATENT AND TRADEMARK OFFICE

CERTIFICATE OF CORRECTION

PATENT NO. : 4,983,154

DATED : January 8, 1991

INVENTOR(S) : T. Nagahashi et al.

It is certified that error appears in the above-indentified patent and that said Letters Patent is hereby corrected as shown below:

Column 14, line 12, (claim 8, line 11) change "aid" to —said—

Signed and Sealed this

Eighteenth Day of July, 1995

Bruce Lehman

*Attest:*

BRUCE LEHMAN

*Attesting Officer*

*Commissioner of Patents and Trademarks*